US010155571B2

(12) United States Patent
Warnan et al.

(10) Patent No.: US 10,155,571 B2
(45) Date of Patent: Dec. 18, 2018

(54) FAIRING ELEMENT, FAIRING, ELONGATE FAIRED ELEMENT AND TOWING ASSEMBLY

(71) Applicant: THALES, Courbevoie (FR)

(72) Inventors: François Warnan, Plouzane (FR); Michaël Jourdan, Plouzane (FR); Olivier Jezequel, Saint Thonan (FR)

(73) Assignee: THALES, Courbevoie (FR)

( * ) Notice: Subject to any disclaimer, the term of this patent is extended or adjusted under 35 U.S.C. 154(b) by 0 days.

(21) Appl. No.: 15/553,065

(22) PCT Filed: Feb. 26, 2016

(86) PCT No.: PCT/EP2016/054151
§ 371 (c)(1),
(2) Date: Aug. 23, 2017

(87) PCT Pub. No.: WO2016/135325
PCT Pub. Date: Sep. 1, 2016

(65) Prior Publication Data

US 2018/0244352 A1 Aug. 30, 2018

(30) Foreign Application Priority Data

Feb. 27, 2015 (FR) ..... 15 00389

(51) Int. Cl.
*F15D 1/10* (2006.01)
*B63B 21/66* (2006.01)
*B66D 1/36* (2006.01)

(52) U.S. Cl.
CPC ..... *B63B 21/663* (2013.01); *B66D 1/36* (2013.01)

(58) Field of Classification Search
CPC ..... B63B 21/56; B63B 21/66; B63B 21/663; B63B 2021/56; B63B 2021/66; B63B 2021/666; B66D 1/36; F15D 1/10
(Continued)

(56) References Cited

U.S. PATENT DOCUMENTS 2,859,836 A 11/1958 Wiener
3,233,571 A * 2/1966 Rather ..... B63B 21/663 114/243

(Continued)

FOREIGN PATENT DOCUMENTS

CA 1 059 841 A 8/1979
WO 2009/060025 A1 5/2009

*Primary Examiner* — Daniel V Venne
(74) *Attorney, Agent, or Firm* — Baker & Hostetler LLP

(57) ABSTRACT

A fairing element to fair an elongate element comprising a canal to accept the elongate object and being profiled in such a way as to reduce the hydrodynamic drag of the elongate object when the elongate object is at least partially immersed, the fairing element comprises a leading edge and a trailing edge, the fairing element being intended to be pivot-mounted on the elongate element around the longitudinal axis of the canal, the fairing element comprising a bearing edge comprising a first bearing edge which is mitered with respect to the leading edge, the first bearing edge being arranged in such a way that the distance between the leading edge and the bearing edge, considered perpendicular to the leading edge, decreases continuously, along an axis parallel to the leading edge, from a first end of the first bearing edge to a second end of the bearing edge, the fairing element being referred to as a mitered fairing element, the mitered fairing element comprising a first part and a second part which are joined together along a first bearing edge so that the fairing element can pass from a deployed configuration in which the trailing edge is parallel to the leading (Continued)

edge to a folded configuration in which the fairing element is folded along the first bearing edge.

20 Claims, 12 Drawing Sheets

(58) Field of Classification Search
USPC ..... 114/242, 243, 244, 253, 254
See application file for complete search history.

(56) References Cited

U.S. PATENT DOCUMENTS

| | | | | |
|---|---|---|---|---|
| 3,354,860 | A * | 11/1967 | Dale | G01V 1/38 114/243 |
| 3,379,162 | A | 4/1968 | Chatten et al. | |
| 3,962,982 | A | 6/1976 | Marchay et al. | |
| 4,829,929 | A | 5/1989 | Kerfoot | |
| 6,575,114 | B2 * | 6/2003 | Sandler | A63B 35/00 114/244 |

* cited by examiner

FAIRING ELEMENT, FAIRING, ELONGATE FAIRED ELEMENT AND TOWING ASSEMBLY

CROSS-REFERENCE TO RELATED APPLICATIONS

This application is a National Stage of International patent application PCT/EP2016/054151, filed on Feb. 26, 2016, which claims priority to foreign French patent application No. FR 1500389, filed on Feb. 27, 2015, the disclosures of which are incorporated by reference in their entirety.

FIELD OF THE INVENTION

The present invention relates to faired towing cables used on ships for towing a submersible body launched at sea and to the handling of these cables. It relates more particularly to towing cables which are faired using scales or portions articulated to one another. It also applies to any type of faired elongate element that may operate at least partially submerged in water.

BACKGROUND

The context of the invention is that of a naval vessel or ship intended to tow a submersible object such as a variable-immersion sonar incorporated into a towed body. In such a context, in the non-operational phase, the submersible body is stored on board the ship and the cable is wound around the drum of a winch used for winding in and paying out the cable, namely for deploying and recovering the cable. Conversely, in the operational phase, the submersible body is submerged behind the ship and towed by the ship using the cable, of which the end connected to the submersible body is immersed. The cable is wound in/paid out by the winch through a cable guiding device that allows the cable to be guided.

In order to obtain a high degree of immersion at high towing speeds, the towing cable is faired to reduce its hydrodynamic drag and to reduce the vibrations caused by the hydrodynamic flow around the cable. The cable is covered with a segmented fairing made up of rigid fairing elements having shapes intended to reduce the hydrodynamic drag of the cable. The purpose of the sheath made up of the fairing elements is to reduce the wake turbulence produced by the movement of the cable through the water, when the cable is immersed in the water and towed by the ship. For great immersion depths that go hand-in-hand with high towing speeds of at least 20 knots, the fairing elements need to be rigid. Flexible fairings are of benefit only for economically profiling chains or cables for buoys subjected to marine currents or, at worst, towed at speeds of 6 to 8 knots. In the case of the use of rigid fairing elements, segmenting the fairing into fairing elements is necessary so that the cable can pass through guide elements of the pulley type, and so that lateral cable deflection can be tolerated in case the ship changes heading and also so as to be able to be wound onto the drum of a winch.

In the normal operating state, the fairing elements are mounted with the ability to rotate about the longitudinal axis of the cable. This is because it is necessary for the fairing elements to rotate freely about the cable so as to be correctly oriented with respect to the stream lines of the water. However, each fairing element is connected to its two neighbors axially and in terms of rotation about the cable to pivot with respect to these about an axis parallel to the axis x by a maximum angle that is small, of the order of a few degrees. This link between the fairing elements in particular allows the fairing as a whole to pass fluidly through all the guide elements. As a result, the rotation of one of one fairing element leads to a rotation of its neighbors and so on and so forth through the entire set of fairing elements. Thus, both when the cable is deployed in the water and when it is wound around the drum, any change in orientation of one of the fairing elements has a knock-on effect on all of the fairing elements fairing the cable. Thus, when the cable is deployed at sea, the fairing elements naturally orientate themselves in the direction of the current generated by the movement of the vessel. Likewise, the guide device is conventionally configured to orientate and guide the fairing elements that pass through the guide device that these exhibit a predefined orientation with respect to the drum of the winch, all the fairing elements, as the cable is raised, adopting one and the same orientation relative to the drum, which orientation allows the cable to be wound in keeping the scales parallel to one another turn by turn.

Now, the applicant company has found that, when the faired cable is wound around the drum of a winch so as to recover the towed body, the fairing sometimes becomes severely damaged or even crushed as it passes through the guide devices, this being something which may render the entire sonar system unavailable. It may even happen that this damages the guide device. By way of example, certain variable-immersion sonar systems installed on certain ships and operated in the normal way by military crews encounter fairing-element-crushing problems approximately once a year and sometimes far more frequently. This crushing may have limited consequences but may also degenerate or jam the winch or damage it, and thus cause the entire towing system and therefore the sonar to become unavailable.

SUMMARY OF THE INVENTION

It is one object of the present invention to limit the risks of damage to the fairing of a towed cable.

To this end, the applicant company has first of all, in the context of the present invention, identified and studied the cause of this problem of the fairing elements becoming crushed by observing the faired cable in an operational situation and by modeling the faired cable in an operational situation and by modeling the various forces acting on it, notably the hydrodynamic and aerodynamic flows, and the force of gravity.

During the operational phase, the faired cable is towed by the ship and has one end immersed. Very often, the tow point is a point on a pulley which is situated a certain height above the water. What is meant by the tow point of a cable or of a fairing is the position of the point at which the cable bears against a device on board the ship, which is closest to the immersed end of the cable or respectively of the fairing. As the ship moves forward, under the action of drag the cable moves away from the transom to disappear beneath the water a little further afield than a point vertically below the tow point. The length of faired cable that is airborne is increased in comparison with the simple height of towing above the waterline because the cable is inclined with respect to the vertical. It is found that the last fairing element still engaged with the ship, namely the fairing element which is at the tow point, often resting on the pulley or resting on a guiding device on board the ship, is oriented correctly in the direction of the flow even though it is considerably higher up in the air (leading edge facing into the flow and trailing edge trailing). The first fairing element in the water (namely the fairing element that is just immersed) is assumed to adopt a correct orientation in the flow stemming from the speed of the ship (leading edge facing into the flow and trailing edge trailing). However, between these two remarkable fairing elements, the string of fairing may twist because, in the air, it is subjected only to vibration, to an insignificant flow of air and to the effect of gravity. Under the effect of the influences of the sea, of the towing conditions and of the waves, situations whereby this airborne string twists are regularly observed. The first cause of twisting is the effect of gravity as soon as the cable moves away from the vertical, something which it has to do as soon as the towing speed becomes sufficient. Under the effect of gravity, the string of fairing between the tow point and the sea will twist to one side (in the air) and then straighten up (in the water). This is the nominal situation of the string of fairing. This twist is dependent on the intrinsic stiffness of the string of fairing and also on the length airborne. A situation in which the airborne part of the fairing 2 is a little twisted, namely experiences torsion about the axis of the cable, is depicted in FIG. 1A. In FIG. 1A, the vertical direction in the Earth's frame of reference is represented by the axis z and the orientation of the section of certain fairing elements in zones A, B and C delimited by dotted line has been depicted. In the situation depicted in FIG. 1A, the last fairing element 3, which is engaged with the ship, is oriented vertically (trailing edge uppermost) as depicted in zone A. The fairing elements that are in the air between the pulley P and the water surface S are lying down under the effect of gravity. In other words, as visible in zone B, the trailing edge of the fairing elements is oriented downward (between the pulley P and the water surface S, the fairing elements have rotated about the cable). By contrast, the fairing elements that are in the water have straightened up under the action of the flow of water acting in the direction of the arrow FO as depicted in zone C (trailing and leading edges both situated at approximately the same depth).

Occasionally, depending on the sea conditions, with green seas or waves breaking more or less over the transom of the ship, the airborne part of the cable temporarily experiences flow in the opposite direction to that prevailing lower down and which corresponds to the speed of forward travel of the ship. These packets of water are perfectly capable of twisting the string of fairing still further and of placing it in opposition with the position expected in the normal towing stream. When that happens, the fairing is twisted and makes a half-turn about the cable in its airborne part. That means that two fairing elements of the airborne part of the string of fairing have trailing edges that between them form an angle of 180 degrees around the cable. The part of the fairing situated between these two fairing elements is twisted or in torsion. Starting out from this situation, it may happen that these parts of fairings which are therefore the wrong way round with respect to the mean stream imposed by the speed of the ship then suddenly find themselves immersed in this mean stream again (because of the movements of the ship that of the waves, etc.) so the part of the fairing that is the wrong way around is therefore urged to return to the right direction (the direction associated with the normal mean stream). It may then:

- cancel its half-turn and return to its initial position by making the opposite rotation to the rotation that led it to become the wrong way round. It then finds itself correctly oriented.
- or add to the existing half-turn a further half-turn which returns it to the correct orientation in the stream but has the effect of twisting the airborne part of the fairing above it by 1 turn (or 360°) and of similarly twisting a portion below it by one turn (or 360°, but this time in the other direction). The part which was initially the wrong way round has returned to the correct orientation in the main stream associated with the speed of the ship, but this has resulted in two twistings by one turn, one of the above it in the air and the other below it in the water. The name given to this is a full twist of the fairing. This full twist is a stable situation of the string of fairing or of the fairing 2. It is depicted in FIG. 1B. This situation may be described as follows: between the tow point R and the water surface S, the string of fairing undergoes a full turn in the direction of the arrow F1 about the cable. The string of fairing 2 passes through the surface S and remains correctly oriented over a certain length L of a few meters or sometimes less. The string of fairing 2 then makes a complete revolution in the water, in the opposite direction, depicted by the arrow F2, to return to the correct orientation in the stream. In other words, the fairing undergoes a double full twist about the cable. The double twist comprises an airborne full twist, situated above the water surface and an immersed full twist situated below the water surface. All of the part of the fairing that is situated below this double full twist is now completely unaffected by what happens above it (its fairing elements are correctly oriented in the stream).

The configuration in which the fairing undergoes a double twist is stable but highly degraded and carries a high risk of subsequently introducing a great deal of disturbance into the entire system.

The applicant company has discovered that when a fairing experiences a complete double twist, under certain conditions, the fairing will become very much deteriorated in the water and this deteriorated part will cause a great deal of damage to the faired cable or even to the entirety of the faired system as the cable is being wound in and, more specifically, as it passes through the cable guiding device.

By analyzing the complete double twist, the applicant company has found that the submerged twist can be considered to be "caught" on the cable. In other words, the position of the submerged twist is fixed with respect to the cable along the axis of the cable. By contrast, its airborne counterpart, the airborne twist, remains situated at the same point between the tow point R and the water surface S. It is not fixed with respect to the cable along the axis of the cable but fixed with respect to the water surface S or to the tow point. When the cable is hauled in or lowered, the fairing elements experiencing the submerged twist follow the movement of the cable which is being hauled in or lowered, while the airborne twist remains fixed with respect to the water surface. From this it follows that a paying-out of the cable causes the submerged twist to sink to a greater depth while the airborne twist remains in the same place with respect to the water surface (so the 2 twists move further apart). FIG. 1C depicts a situation in which the cable has been paid out with respect to the situation of FIG. 1B (see arrow). The distance L2 represents the distance between the part of the fairing affected by the submerged twist and the point at which the fairing enters the water is greater than the distance L1 which represents this same distance in the situation of FIG. 1B. Conversely, a hauling-in of the cable, with respect to the situation of FIG. 1B, in the direction of the arrow represented in FIG. 1D, causes the submerged twist to rise while the airborne twist still remains in the same place with respect to the water surface (so the two twists move closer together).

It is then necessary to examine what happens for a twist of one turn that is immersed and towed in that state. This twist which deploys over a small height forces the fairing elements to travel backwards or across the stream. The action of the stream on these fairing elements is therefore very great (proportional to the surface area, angle, density of the water and the square of the speed) and this action manifests itself in the form of powerful torsional moments which tend to force the fairing elements to align in the stream but they come up against the stiffness of the turn of twist which therefore increases. What happens then is that a balance is struck and that the one-turn twist finds itself very much restricted in height and the fairing experiences violent loadings which will tighten the submerged twist under the effect of the towing speed. In other words, the full turn of the fairing about the cable will take place over an ever-shortening distance. Observations at sea have shown that the string of fairing could effect one full turn around the cable over a length of under 50 cm. During towing, the hydrodynamic stream applies a very high torque to the incorrectly oriented fairing elements which may go so far as to damage the fairing or even as to completely break the fairing elements.

When a submerged twist is hauled in, the fairing has been very highly stressed for a long time and retains the memory of its deformation (namely of its twisting), and the submerged twist comes out of the water still very tightly twisted during hauling and does not disappear during the hauling. This is referred to as remnant twist. Depending on the length of time for which the fairing has been exposed to this submerged twist and towed, the submerged twist may be able to become permanent or very slow to be reabsorbed, making it completely unable, for a fairly long period of time, to engage in the cable guide device even though the continuity of the fairing is unbroken. On the airborne twist side there is no damage, although there is a twist applied it is not at any time capable of damaging the cable.

When the still very tightly twisted submerged twist then arrives at the guide device, for example the pulley, the fairing elements affected by this submerged twist are unable to position themselves correctly in the guide device, notably in the pulley, and they jam in the guide device. If that happens, then the entire string of fairing that enters the guide device afterwards will be methodically destroyed if hauling is continued because each fairing element will, in sequence, follow the orientation of the one before it. This situation may even cause the guide device to break.

The invention proposes to limit the risks of damage to the cable fairing.

To this end, one subject of the invention is a fairing element intended to fair an element comprising a canal intended to accept the elongate object and being profiled to reduce the hydrodynamic drag of the elongate object when the elongate object is at least partially immersed, said fairing element comprising a leading edge and a trailing edge, said fairing element pivot-mounted on the elongate element around the longitudinal axis of the canal, said fairing element comprising a bearing edge comprising a first bearing edge which is mitered with respect to the leading edge, the first bearing edge being arranged in such a way that the distance between the leading edge and the bearing edge, perpendicular to the leading edge, decreases continuously, along an axis parallel to the leading edge, from a first end of the first bearing edge to a second end of the bearing edge, said fairing element being a mitered fairing element.

Advantageously, the mitered fairing element comprises a first part and a second part which are joined together along a first bearing edge so that the fairing element can pass from a deployed configuration in which the trailing edge is parallel to the leading edge to a folded configuration in which the mitered fairing element is folded along the first bearing edge.

Advantageously, said mitered fairing element being configured so as to pass from the deployed configuration into the folded configuration when a torque inducing relative pivoting between the two parts, applied about an axis comprised in the first bearing edge and parallel to the longitudinal axis of the first bearing edge, exceeds a predetermined threshold.

Advantageously, the threshold is higher than a nominal torque to be exerted by a hydrodynamic stream of water on the fairing element when the fairing element is immersed.

The cross section of the mitered fairing element may be constant or variable along the leading edge.

The two parts may arranged back to back along the first bearing edge.

The mitered fairing element is advantageously configured to pass reversibly from the deployed configuration to the folded configuration.

According to a first embodiment, the first part and the second part arranged back to back along the first bearing edge and the first part has a stiffness greater than that of the second part so that the fairing element passes from the deployed configuration into the folded configuration by folding of the second part.

Advantageously, the second part is made from a homogenous material.

According to a second embodiment, the first part and the second part are connected by a pivot connection. The fairing element may comprise a stabilizing device configured to keep the two parts in the deployed relative position when the relative pivoting torque is less than or equal to the threshold and so as to allow the two parts to rotate relative to one another so that they pass into the relative position of folding around the first bearing edge when the torque exceeds the threshold.

As an alternative, the first bearing edge is a flexible hinge zone connecting the two parts and having a stiffness lower than the stiffness of each of the two parts so that the fairing element passes from the deployed configuration to the folded configuration by bending of the flexible hinge zone.

Advantageously, the bearing edge is arranged in such a way that the distance between the bearing edge and the leading edge decreases continuously, along an axis parallel to the leading edge, from the first end of the first bearing edge to a first lateral face of the fairing element closer to the second to the first bearing edge than to the first end of the bearing edge.

The invention also relates to a fairing comprising a plurality of fairing elements which are intended to fair an elongate element comprising a canal intended to accept the elongate object and being profiled to reduce the hydrodynamic drag of the elongate object when the elongate object is at least partially immersed, and which are pivot-mounted on the elongate element around the longitudinal axis of the canal, in which at least one of the fairing elements is a mitered fairing element according to the invention.

Advantageously, the fairing comprises at least one fairing portion comprising a plurality of fairing elements joined together along the axis of the canal and articulated to one another, said portion comprising at least one end fairing element, adjacent to one single other fairing element belonging to said portion, being a mitered fairing element so that it has having a bearing edge comprising a first bearing edge which is mitered with respect to the leading edge, the first bearing edge being arranged in such a way that the distance between the leading edge and the first bearing edge, perpendicular to the leading edge, decreases continuously, along an axis parallel to the leading edge, from a first end of the first bearing edge to a second end of the first bearing edge, further away from the other fairing element than the first end, along the axis parallel to the leading edge.

Advantageously, each mitered fairing element is an end fairing element.

Advantageously, the mitered fairing element is sized to be more resistant to a pressure loading, applied in a direction perpendicular to the leading edge and connecting the leading edge to the trailing edge, than the other fairing elements.

The invention also relates to a faired elongate element that may be operated at least partially immersed, comprising an elongate element faired by means of the fairing according to the invention, the elongate element being received in the canal, said fairing elements being pivot-mounted on the elongate element about the longitudinal axis of the canal and being translationally immobilized with respect to the elongate element along the axis of the elongate element.

The invention also relates to a towing assembly comprising a faired elongate element according to the invention and a towing and handling device intended to tow the faired elongate element while the latter is partially immersed, the towing device comprising a winch allowing the faired elongate element to be wound in and paid out through a guide device that allows the elongate element to be guided, the guide device comprising a first groove the bottom of which is formed by the bottom of the groove of a pulley, the first groove being delimited by a first surface having a profile that is concave in a radial plane of the pulley, the width of the first groove and the curvature of the profile of the first curved surface in the radial plane being determined to allow the fairing element, under the effect of the rotation of the fairing element about the axis of the elongate element x under the effect of the traction of the elongate element with respect to the guide device along the longitudinal axis thereof, to flip from a turned-over position in which the fairing element is oriented with its trailing edge toward the bottom of the first groove into an acceptable position in which it is oriented with the leading edge toward the bottom of the first groove.

Advantageously, the mitered fairing element is configured to fold along the first bearing edge as it flips from the turned-over position into the acceptable position.

BRIEF DESCRIPTION OF THE DRAWINGS

Other features and advantages of the invention will become apparent on reading the detailed description which follows, given by way of non-limiting example and with reference to the appended drawings in which:

FIGS. 8*b* and 8*c* depict sections of the pulley on planes successively occupied by the same lateral face of the fairing element as the cable is wound in.

DETAILED DESCRIPTION

The invention relates to a fairing intended to cover an elongate object, for example a flexible object such as a cable, or a rigid object such as an offshore drill string, that may be operated at least partially immersed. The elongate element may be conventionally towed by a floating vessel. The fairing is intended to reduce the forces generated by the current on this elongate element when it is immersed in the water and towed through the water by a naval vessel.

Figure 1A:
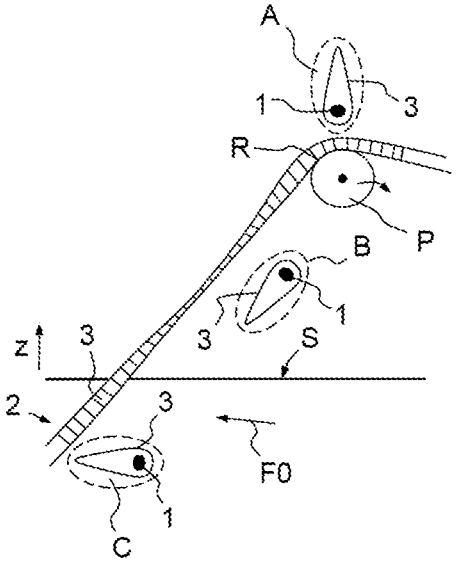
FIG. 1A, already described, depicts a faired cable, faired by means of rigid fairing elements joined axially together, towed partially immersed from its immersed part as far as a guide pulley in a situation in which the cable does not experience a double twist.
Figure 1B:
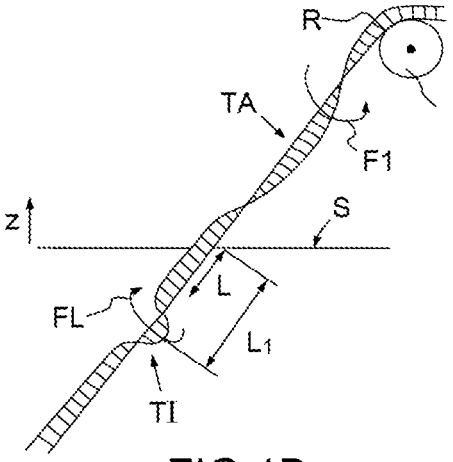
FIG. 1B depicts the cable of FIG. 1A in the same state of immersion (namely of winding-in and of paying-out) as in FIG. 1A, but experiencing a double twist.
Figure 1C:
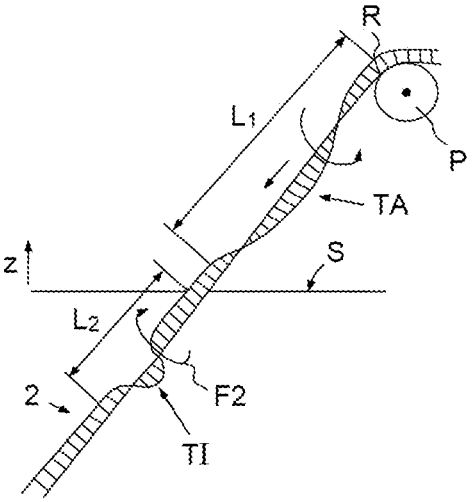
FIG. 1C depicts the cable of FIG. 1A with the double twist of FIG. 1B in a configuration in which the cable has been paid out in relation to FIG. 1B.
Figure 1D:
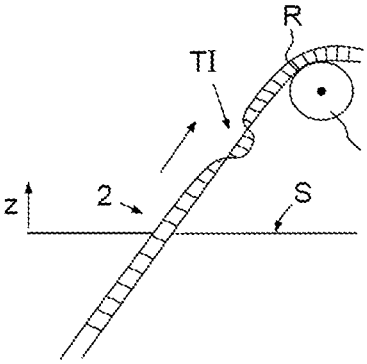
FIG. 1D depicts the cable of FIG. 1A exhibiting the double twist of FIG. 1B in a configuration in which the cable has been hauled in in relation to FIG. 1B, FIG. 2 schematically depicts a ship towing a towed object by means of a faired cable, FIG. 3 schematically depicts a portion of faired cable according to the invention faired using a fairing according to the invention.
Figure 2:
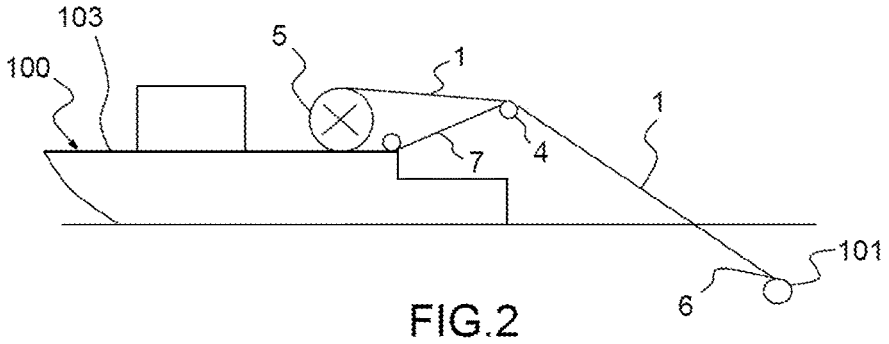

Another subject of the invention is a towing assembly as depicted in FIG. 2, comprising an elongate element 1 faired by means of a fairing according to the invention. In the continuation of the text, the invention will be described in the case where the elongate element is a cable, but it does apply to other types of flexible elongate element.

The cable 1 tows a towed body 101, for example comprising one or more sonar antennas. The towed body 101 is mechanically anchored to the cable 1 in an appropriate manner. The towed body 101 is put into and removed from the water by means of a winch 5 arranged on a deck 103 of the ship 100.

The towing assembly according to the invention also comprises a device for towing and handling the faired cable, comprising:

- a winch 5 for winding in and paying out the faired cable 1,
- a guide device 4 for guiding the cable 1, the guide device being positioned downstream of the winch when viewed from the end 6 of the cable 1 that may be immersed. In other words, the cable 1 is wound in around the winch 5 (or paid out by means of the winch) through the guide device 4.

The guide device 4 is advantageously mounted on a bearing structure 7 and may be fixed to the ship and which may or may not be capable of pivoting.

The guide device provides guidance for the cable 1, which means to say is able to limit the lateral deviation of the cable with respect to the winch in a direction parallel to the axis of rotation of the drum of the winch. It is also advantageously configured to modify the direction of the cable between its end 6 that may be immersed and the winch 5 in a plane substantially perpendicular to the axis of the winch while at the same time making it possible to safeguard the radius of curvature of the cable so that it does not drop below a certain threshold in this plane.

Figure 3:
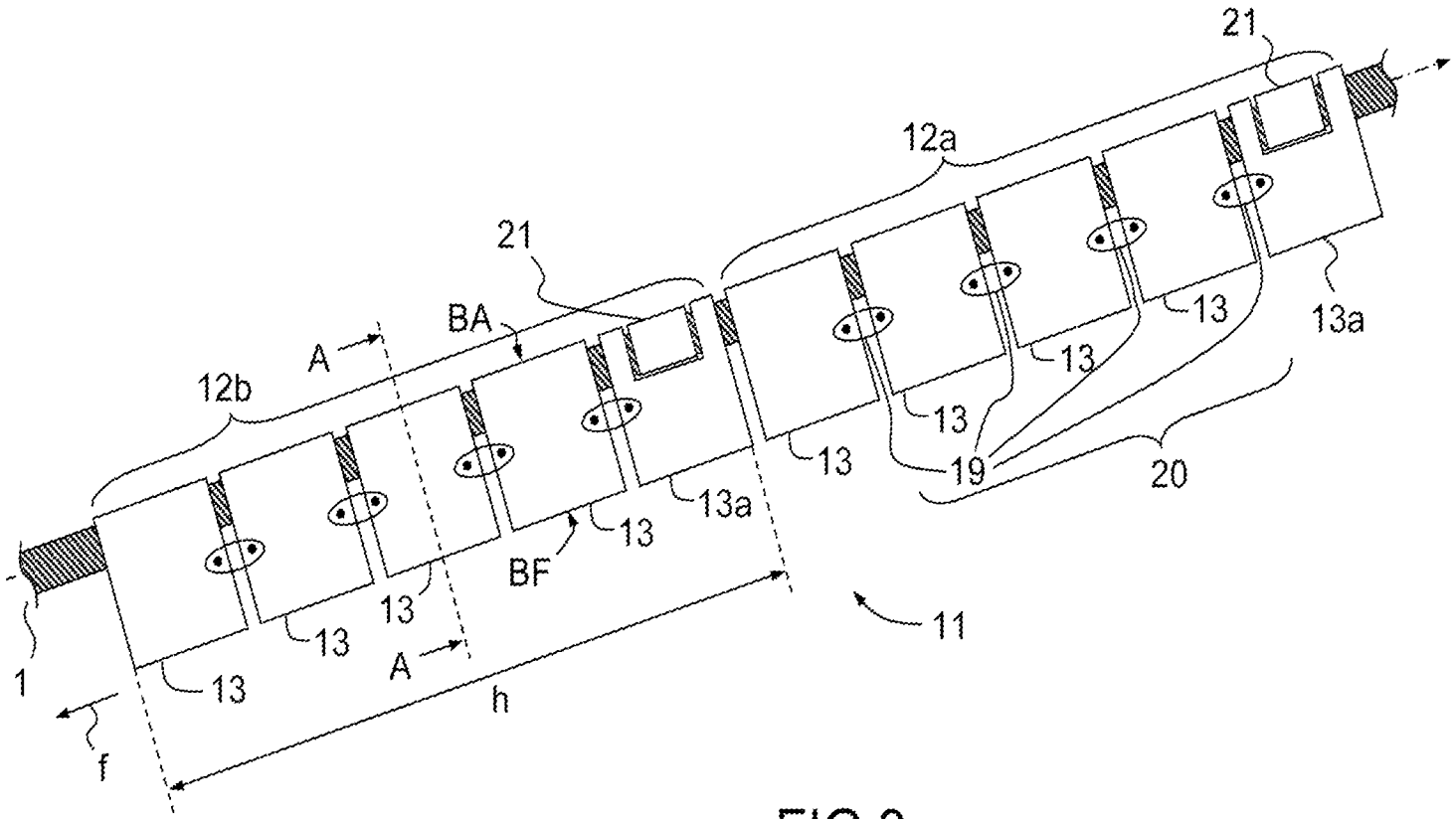

In the nonlimiting example depicted in FIG. 3, the guide device is a pulley 4. The guide device may further comprise, amongst other things, a fairlead to safeguard the radius of the cable and/or a reeling device so that the cable can be stowed correctly on the drum and/or at least one deflector forming a surface that makes it possible to alter the orientation of a fairing element with respect to the deflector by rotation of the fairing element about the axis of the cable under the effect of the traction of the cable as it is being wound in/paid out. The latter function may be performed by a pulley.

FIG. 3 schematically depicts a portion of cable 1 covered with a fairing 11 according to the invention. This fairing 11 comprises a plurality of fairing portions 12*a*, 12*b*. Each fairing portion 12*a*, 12*b*, comprises a plurality of fairing elements 13, 13*a*. FIG. 3 depicts two fairing portions 12*a*, 12*b*, each comprising 5 fairing elements of the fairing but, in practice, the fairing may comprise far more fairing portions comprising far more fairing elements.

The fairing elements are advantageously rigid. What is meant in the present patent application by fairing elements that are rigid is that the fairing elements are configured in such a way that they do not deform substantially under the effect of the hydrodynamic stream when immersed and possibly towed in the direction of the leading edge. In other words, the fairing elements maintain substantially the same shape when subjected to the hydrodynamic stream. The fairing elements may potentially deform under the effect of forces stronger than those developed by the hydrodynamic stream. They are, for example, made of hard plastics material such as, for example, polyethylene terephthalate (PET) or polyoxymethylene (POM).

Figure 4A:
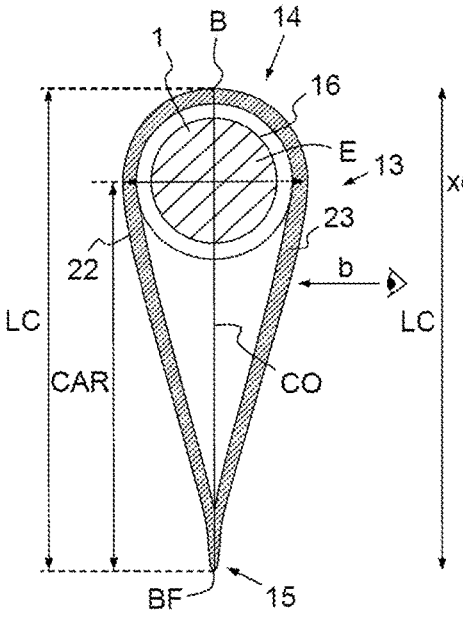
FIG. 4*a* depicts a cross section of a fairing element of the fairing according to the invention on the plane of section AA depicted in FIG. 2, FIG. 4*b* schematically depicts a side view of the fairing element of FIG. 4*a* in the direction of the arrow b, FIG. 5 schematically depicts a portion of faired cable according to the invention entering a cable guide pulley.

Each fairing element 13, 13*a* has a hydrodynamic profile, of the kind depicted in FIG. 4*a*, in a plane AA perpendicular to the axis x of the cable (or axis of the canal 16). In other words, each fairing element 13, 13*a* is profiled to reduce the hydrodynamic drag of the cable 1 when the cable 1 is being towed. The fairing elements 13*a* are fairing elements exhibiting the same features as the fairing elements 13 but able to differ from the fairing elements 13 in terms of the features explained hereinafter because of their position in the portions 12*a*, 12*b*. Each fairing element 13 comprises a wide nose 14 intended to accept the cable 1 and a tail 15 of streamlined shape extending from the nose 14. The nose 14 houses a canal 16 of axis perpendicular to the plane of the sheet, intended to accept the cable 1. The nose 14 comprises the leading edge BA and the tail 15 comprises the trailing edge BF which are the endmost points of the fairing element 13 in the plane of section. The fairing element 13 more particularly in this plane has a wing-shaped profile. The profile of the fairing element allows a less turbulent flow of water around the cable. The hydrodynamic profile exhibits, for example, a teardrop shape or an NACA profile which is a profile defined by the National Advisory Committee for Aeronautics, NACA.

Figure 4B:
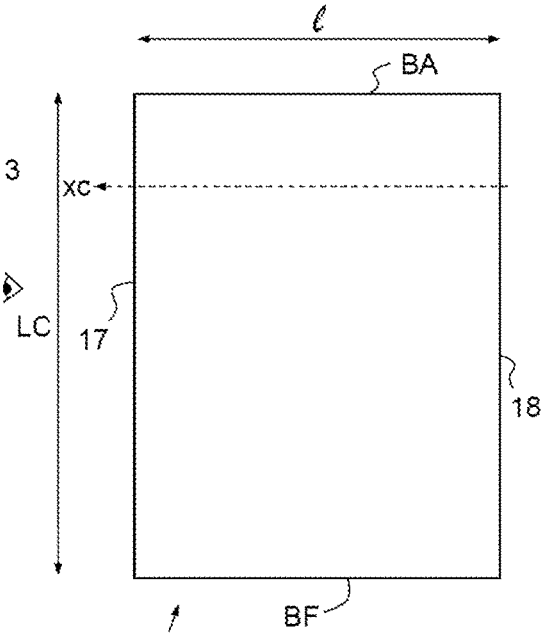

FIG. 4*b* depicts a view of the fairing element in the direction of arrow B, which is the same view as in FIG. 3. The fairing element has a shape that is elongate from the leading edge BA to the trailing edge BF. In side view, the fairing element 13 has a substantially rectangular shape delimited by the trailing edge BF and the leading edge BA which are parallel to the axis xc of the canal 16 and connected by two lateral faces 17, 18. The lateral faces 17, 18 extend substantially perpendicular to the trailing edge BA. The lateral faces are arranged at the respective ends of the canal 16.

In FIG. 4*a*, the chord length of the fairing element 13, which has been referenced LC, is the maximum length of the straight-line segment defining a chord CO connecting the trailing edge BF and the leading edge BA of the fairing element 13 in a direction perpendicular to the axis of the canal xc. In other words, the chord is the straight-line segment connecting the endmost points of a section of the fairing element. The maximum thickness E of the fairing element is the maximum distance separating the first longitudinal face 22 from the second longitudinal face 23 in a direction perpendicular to the chord CO in the plane of section of the fairing element. In the embodiment of FIG. 4*b*, the distance separating the trailing edge and the leading edge is constant along the axis of the canal xc parallel to the leading edge BA. This distance is the chord length. The longitudinal faces 22 and 23 run parallel to the leading edge BA.

The fairing elements 13 may be mounted on the cable 1 to pivot about the longitudinal axis of the cable 1, namely about the longitudinal axis of the canal 16.

The fairing elements 13 belonging to one and the same portion of fairing 12*a* or 12*b* are joined together by means of a coupling device 20 that allows relative rotation of said fairing elements 13 with respect to one another about the cable 1. The coupling device 20 joins the fairing elements together both axially, namely along the towing cable, and also in terms of rotation about the cable 1. The coupling device 20 allows relative rotation of the fairing elements with respect to one another about the axis of the cable, namely of the canal 16. This excursion is permitted either freely with a stop. The rotation of one fairing element about the cable therefore does not cause the adjacent fairing element to turn. The excursion may be achieved in a constrained manner, with more or less strong return toward the aligned position (position of no relative rotation of the fairing elements relative to one another about the cable). In the latter instance, rotation of one fairing element about the cable causes the adjacent fairing elements of the same portion to rotate about the cable. Advantageously, the clearance between adjacent fairing elements is near zero, which means that any relative rotation of the fairing elements leads to elastic deformation of the coupling device. That allows the fairing elements of one and the same portion to adopt an orientation with respect to the cable that allows it to offer the least resistance to the current brought about by the movement of the cable through the water. The coupling device allows this relative rotation with a maximum amplitude, namely a maximum angular excursion. Thus, the rotation of one fairing element causes the neighboring fairing elements and, through a knock-on effect, all of the fairing elements of the same portion 12*a* or 12*b* to rotate. As the cable is raised, all the fairing elements of one and the same portion adopt one and the same orientation relative to the drum thereby allowing the cable to be wound in keeping the scales parallel to one another turn by turn.

Advantageously, the coupling device 20 allows the relative rotation of the fairing elements with respect to one another to allow the cable to be wound around a winch, the lateral excursion of the cable being caused, for example, by changes in heading of the ship. The coupling device allows these movements of relative rotation of these fairing elements with respect to one another with maximum respective angular excursions. The coupling device 20 depicted in FIG. 3 comprises a plurality of individual coupling devices 19 comprising, for example, a fishplate, each allowing a fairing element to be connected to a fairing element adjacent to said fairing element, which means to say allowing the fairing elements of one and the same portion to be coupled one to the next. In other words, each individual coupling device allows a fairing element to be connected to another fairing element adjacent to said fairing element only. The adjacent fairing elements form pairs of fairing elements. The fairing elements of the respective pairs of fairing elements of one and the same portion of fairing are connected by means of distinct individual coupling devices. The coupling device thus allows each fairing element of a portion of fairing to be connected individually to each of its adjacent fairing elements. Advantageously, the individual coupling devices are configured to deform elastically upon relative rotation of the fairing elements around the cable. This refers to a twisting of the individual coupling devices.

When there is torsion in a portion of fairing, there is deformation in the portion of fairing. This deformation is obtained through elastic deformation of the coupling device 20 and/or of the fairing elements so that the portion of the fairing opposes the torsion because of its torsional stiffness. In other words, the fairing applies a return torque in the opposite direction to the torsional torque applied to the fairing in order to generate the twist. These elastic deformations are torsions. When the fairing comprises individual coupling devices 19, the individual coupling devices 19 deform elastically as the fairing is twisted. Conventionally, the fairing elements have a stiffness such that they too deform elastically when the fairing is twisted. These elastic deformations are torsions.

Advantageously, the fairing elements 13 are immobilized translationally with respect to the cable 1 along the axis of the cable x. That makes it possible to prevent the fairing elements 13 from becoming squashed together or spread out along the cable 1, either of which could have the effect of causing the fairing 11 to jam during the winding-up of the faired cable around the drum of the winch 5 or even when passing through the guide device 4. For this purpose, each portion of fairing 12*a*, 12*b* comprises an immobilizing device 21 collaborating with a fairing element 13*a* of said portion 12*a*, 12*b* and intended to collaborate with the cable 1 so as to immobilize the fairing element 13*a* translationally along the axis of the cable. According to the embodiment of FIG. 3, the fairing element 13*a* is the fairing element furthest from the end 6 that may be submerged situated in the direction of the arrow f (defining a head-end fairing element) Because the fairing elements are joined together, the immobilization achieved by the immobilizing device on one fairing element 13*a* has a knock-on effect on the other fairing elements of the same portion. There is no need to install one immobilizing device per fairing element, and this makes it possible to limit costs and fitting time as well as limiting the weight of the faired cable. As an alternative, the portion comprises several immobilizing devices each one collaborating with one fairing element of the portion. The immobilizing device for example comprises a ring 21 fixed to the cable by crimping and collaborating with the fairing element 13*a* so as to immobilize it translationally with respect to the cable along the axis x of the cable 1.

According to the invention, the fairing portions 12*a*, 12*b* are free to rotate relative to one another about the axis of the canal 16, namely about the axis of the cable 1 when they are mounted on the cable 1. In other words, the fairing elements 13 belonging to two distinct portions of fairing 12*a*, 12*b* are free to rotate relative to one another about the axis of the canal, namely about the cable 1. Each portion 12*a*, 12*b* is relatively flexible in terms of rotation about the cable even if a certain torsional stiffness is observed. This flexibility only amplifies with deployed length. For this reason, breaking the fairing down into fairing portions which are free to rotate relative to one another makes it possible to limit the risks of the formation of double twists and therefore to limit the risk of damage to the fairing, because the twists in the portions of fairing are not transmitted from one portion to another. The fairing may be installed all along the cable. In other words, the fairing extends over the entire length of the cable. As an alternative, the fairing extends along the cable over a length less than the length of the cable.

The fairing may fair an elongate element. It is also towed by means of a towing device as described in the present patent application.

The heights h of the respective fairing portions, namely their lengths along the axis x of the cable, are less than a maximum height hmax. As an alternative, at least one of the portions has a height less than this maximum height hmax. In FIG. 3, the two portions have the same length, but this is not compulsory. The maximum height hmax is chosen to be small enough to prevent the formation of a complete airborne twist in the portion, for example of a complete twist in the portion. The affected portion may make a complete turn on itself and realign in the stream, and because it is uncoupled from its neighbors, this portion no longer disturbs them and there is no longer any airborne torsion or immersed torsion. This configuration makes it possible to prevent old immersed full twists from entering the guide device and therefore limits the risks of damage to the fairing. Moreover, this configuration makes it possible to avoid the need to set in place a monitoring procedure performed by the crew, or by a monitoring device, aimed at detecting immersed twists, and a mechanical or manual procedure aimed at reabsorbing a detected double twist or aimed at helping an immersed remnant twist coming out of the water to enter the guide device without causing damage.

A portion of fairing T experiencing a twist by an angle θ about the axis x of a cable (or of the canal 16) is subjected to a torque C applied about the axis x of the cable 1. The torque C that makes it possible to obtain this torsion angle is given by the following formula:

$$C = \frac{k\theta}{h}$$

where k is the angular torsional stiffness of the portion of fairing about the axis of the cable (or of the canal) expressed in $Nm^2$/radian, h is the height of the portion of fairing, namely the length of the portion of fairing along the axis of the cable or the longitudinal axis of the leading edge.

The maximum height hmax is dependent on the stiffness of the portions of fairing. The higher the torsional stiffness of the portions of fairing about the axis of the cable, the greater the height they may have. The longer the chord of the fairing, the more affected the portion of fairing will be by the influences of the sea and the towing conditions, and the lower the maximum height of the portions of fairing will be. The torsional disturbances generated by the influences of the sea and the towing conditions are proportional to the surface area of the fairing elements of the portion (and therefore to the chord length) and to the lever arm (and therefore to the chord length of the fairing). The maximum height hmax is therefore given by the following formula:

$$hmax \leq \frac{\pi * k}{F\,LC^2}$$

where F is a constant calculated according to a configuration identified as being the most influential and which takes account of the flow and reflow of the wake and LC is the chord length of the fairing elements of the portion of fairing.

The constant F is comprised between 250 and 500. F is dependent on the maximum speed at which the cable is to be towed. If the cable is to be towed at a speed of 20 knots, F is fixed at 400. F is lower if the maximum speed decreases.

Typically, for fairings with an angular torsional stiffness k of the order of 4 to 5 $Nm^2$/rad, and a chord length LC of 0.125 m, the maximum height is of the order of 2 m if the constant is fixed at 400.

The fairing according to the invention offers advantages even when there is no desire to wind the cable around a winch. Specifically, the fact that the fairing according to the invention minimizes the risks of the formation of double twists means that the risks of fairing damage associated with the aging of the immersed twists can be limited without these entering a guide device. The fairing according to the invention therefore limits the requirements in terms of cable maintenance.

Advantageously, the guide device of the towing assembly according to the invention is configured to make it possible to modify the orientation of a fairing element of the fairing with respect to the guide device by rotation of the fairing element about the axis of the cable under the effect of the traction of the cable with respect to the guide device (along the axis of the cable), when the fairing element exhibits an orientation in which it is bearing on the guide device and in which the line of action of the force applied by the cable to the guide device extends substantially in the direction extending from the axis of the cable as far as the trailing edge of the fairing element.

Advantageously, the guide device is configured to turn a fairing element round from a turned-round position in which it is oriented tail down into an acceptable position in which it is oriented tail up. The orientations up and down are defined with respect to a vertical axis associated with the winch.

These configurations facilitate the winding of the faired cable onto the winch. Specifically, when it is desired to wind the cable around the drum of the winch, the first fairing element of each portion to leave the water rises up toward the guide device and, not being connected to the fairing elements of the preceding portion, turns over trailing edge downmost under the effect of gravity, taking with it the next fairing elements of that same portion of fairing. If the guide device does not allow such a turning-over, the fairing elements will arrive on the drum of the winch incorrectly oriented (it is preferable for the fairing elements to be wound up with their trailing edges uppermost in order to avoid damage to the fairing because the leading edge is stronger).

To this end, the guide device comprises a guide or a set of guides that allows the fairing element to be flipped or its orientation changed. This guide or set of guides may for example comprise a pulley and/or deflector or any other device allowing the orientation of the fairing elements about the axis of the cable to be altered. One nonlimiting example of this type is described in the French patent application published under the number FR2923452. These devices are conventionally arranged upstream or downstream of the pulley as seen from the winch. They are conventionally concave, which means to say of the type having a groove, so as to define a housing intended to accept the fairing element in order to flip it. These guides may be able to follow the cable if the cable deviates laterally parallel to the axis of the pulley (or of the winch), for example by being mounted with the ability to pivot about a substantially vertical axis.

Some towing pulleys are configured to cause the fairing elements to pass with the nose toward the bottom of the groove and the tail facing out of the groove. This arrangement is logical because the towing cable, through which the forces pass, has to be located in the nose of the fairing elements, namely near the leading edge. Some towing pulleys therefore have a narrow V-groove. On leaving the sea and arriving at the towing pulley, the fairing elements which, during their airborne path, have a tendency to orientate themselves with the trailing edge downmost (so upside down) thus find themselves straightened up by degrees thanks to the connections between the fairing elements. When a fairing element is correctly positioned in the groove of the pulley, during hauling-in (and also during paying-out) all the successive ones will become straightened by degrees and pass in the best way through the pulley.

Moreover, the devices that allow the fairing to be turned over (or straighteners) do not perform well when they are installed downstream of the pulley, when viewed from the free end of the cable, because the position of the cable at this point has at least two degrees of freedom: longitudinal and lateral, and present-day straightening devices are incapable of correctly following the cable in these two directions or are devices that are complicated.

Figure 5:
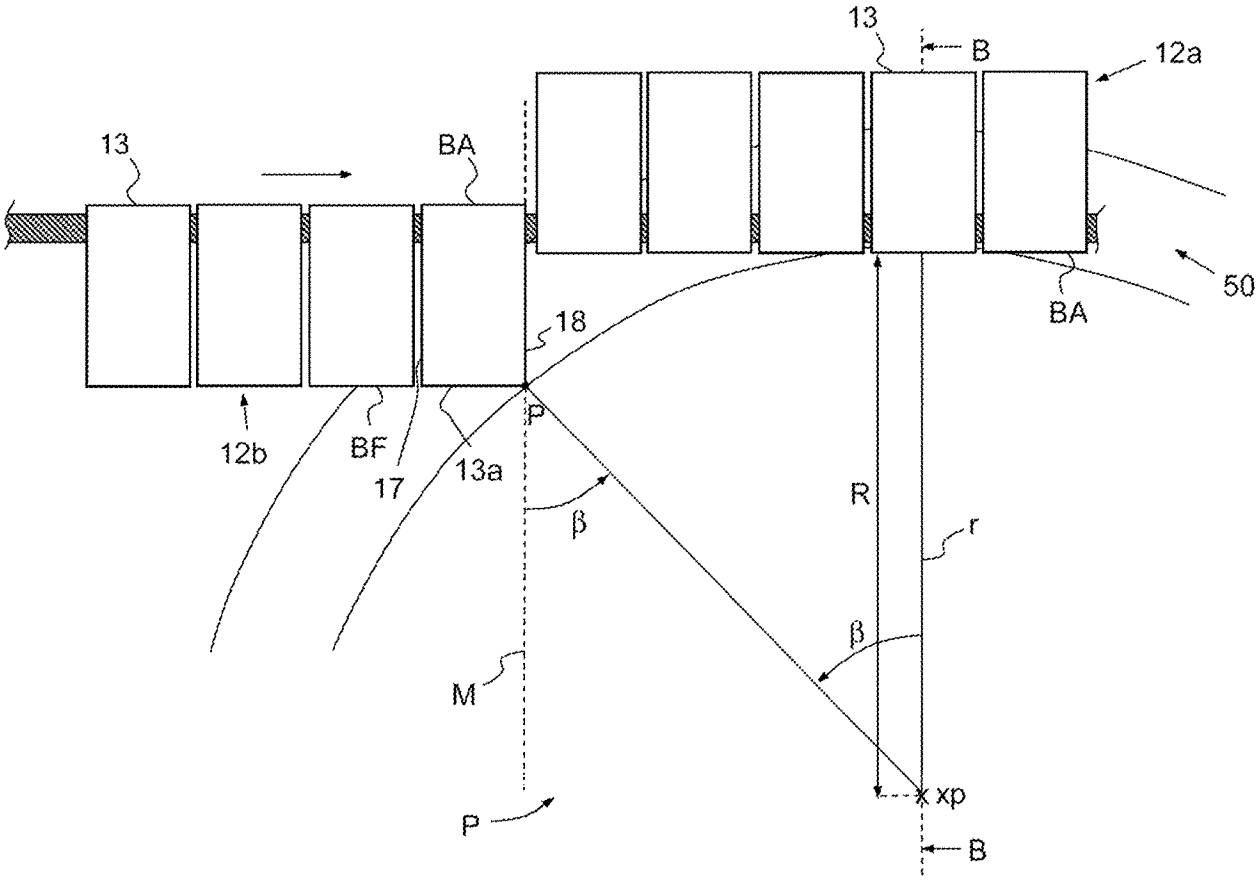
Figure 6A:
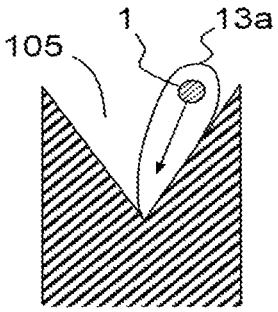
PRIOR ART FIG.6a
FIGS. 6*a* and 6*b* depict cross sections of a pulley according to the prior art, on the lateral face of the fairing element entering with the trailing edge toward the bottom of the groove, at the moment at which it comes to bear against the pulley (FIG. 6*a*) and then afterwards when the cable has been pulled to the right in FIG. 5 (FIG. 6*b*), namely when the cable has been hauled in and its tension has crushed the fairing element)
Figure 6B:
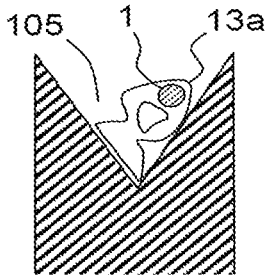
PRIOR ART FIG.6b

In the case of a narrow V-groove pulley, if the guide device has no turning-over device downstream of the pulley as seen from the free end of the cable or if this device does not perform well, fairing elements entering the pulley tail-down may be able to jam in the groove and, if they are not engineered to withstand the force applied by the cable in this orientation, they will deform and cause the subsequent fairing elements to deform. This situation is depicted in FIGS. 5 and 6*a* to 6*b*. FIG. 5 depicts a portion of a faired cable 1 entering a pulley P of groove 50. In this figure, the cable 1, which is therefore entering the pulley in the direction of the arrow, is being wound. In this figure, the axis xp of the pulley is perpendicular to the plane of the page. The fairing elements 13 of a first group of fairing elements 12*a* are oriented with their trailing edge BF facing toward the outside of the groove and leading edge toward the groove. The notable fairing element 13*a* is the head-end fairing element of the portion 12*b*, namely the fairing element 13*a* of the portion 12*b* which is furthest away from the end 6 of the cable that may be immersed. The fairing element 13*a* arrives at the pulley P with its trailing edge BF toward the groove of the pulley and its leading edge BA toward the outside of the groove. This notable fairing element 13*a* belongs to a second group of fairing elements 12*b*.

If the pulley P is a pulley of the prior art, the cross section of the pulley of the prior art in the plane M passing through the lateral edge 18 connecting the trailing edge BF and the leading edge BA of the head-end fairing element is as visible in FIG. 6A. FIG. 6*b* is a cross section of the pulley P of the prior art in another plane comprising the lateral edge 18 of the head-end fairing element 13*a* situated to the right of the plane M in FIG. 5 because, between FIG. 5 and FIG. 6*b*, the cable 1 has been hauled in, namely pulled in the direction of the arrow depicted in FIG. 5, causing the notable fairing element 13*a* to advance in the groove. The groove of the pulley has a V-shaped cross section with an aperture angle of between 20° and 50°. The bottom of the V has a shape that substantially complements the leading edge so that when a fairing element enters the pulley with the leading edge uppermost, the subsequent fairing elements connected to this fairing element will also adopt this orientation as the cable is wound. By contrast, if a head-end fairing element 13*a* arrives with the trailing edge facing toward the groove 105 as is the case in FIG. 6*a*, the groove is too narrow for the fairing element to turn over with its trailing edge uppermost under the effect of the traction of the cable with respect to the groove of the pulley along its axis. The tension in the cable forces the head-end fairing element 13*a* to drop down toward the bottom of the groove. Specifically, as the cable is pulled through the pulley along its axis, it develops a force, on the fairing element, that is directed along the line of action of the force indicated by the arrow in FIG. 6*a*. Now, if the fairing element is not engineered to withstand this stress, it deforms and breaks (or becomes damaged) as depicted in FIG. 6*b*.

In order to alleviate these disadvantages, the invention seeks to give the pulley itself a function of turning the fairing elements over about the axis of the cable.

To this end, the invention consists in providing a towing assembly comprising a guide device for guiding the cable, which is positioned downstream of the winch when viewed from the end of the cable that may be immersed, the guide device comprising a first groove the bottom of which is formed by the bottom of the groove of a pulley, the first groove being configured to allow a fairing element of the fairing to be flipped, by rotation of the fairing element about the axis of the cable x under the effect of the tension in the cable, from a turned-over position in which the fairing element is oriented with its trailing edge (or tail) toward the bottom of the first groove, into an acceptable position in which it is oriented with its leading-edge (or nose) toward the bottom of the first groove, which means to say with its trailing edge toward the outside of the groove. The dimensions and the shape of the profile of the first groove, notably the width of the first groove and the curvature of the profile of the first curved surface (which will be defined later on) in the radial plane are determined as a function of the radius R of the pulley, of the maximum length CAR, measured parallel to the chord separating the trailing edge BF of the fairing elements of the fairing from the axis x of the elongate element 1, of the chord length LC of the fairing elements and of the maximum thickness E of the fairing elements so as to allow the fairing element to be flipped from the turned-over position into the acceptable position.

When the trailing edge (or tail) is oriented toward the bottom of the first groove, that means that the trailing edge (or the thin end of the tail) is situated a shorter distance than the leading edge (or than the nose) away from the axis of the pulley xp. The axis of the pulley is the axis about which the pulley pivots with respect to the winch, namely with respect to the fixed part of the winch. Advantageously, the axis of the pulley is substantially horizontal, namely intended to run parallel to the water surface when the sea state is calm when the towing device is fixed to a naval vessel or ship. The bottom 26 of the groove of the pulley forms a circle of radius R the center of which lies on the axis of the pulley.

Figure 7:
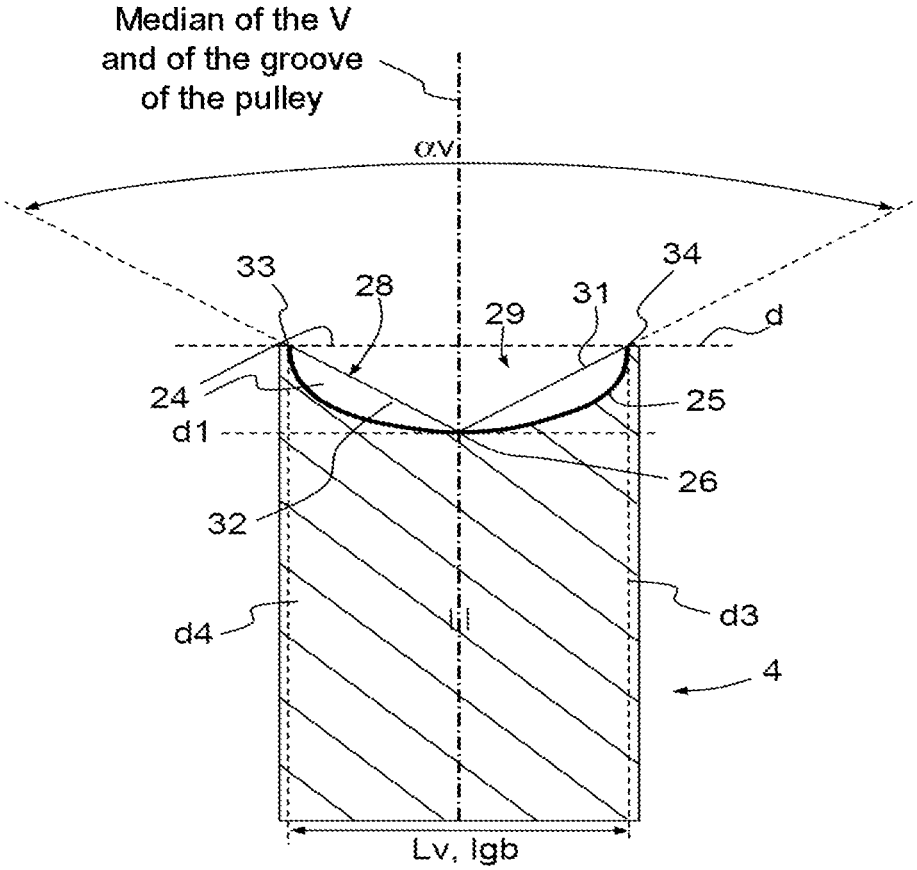
FIG. 7 depicts a partial cross section on a radial plane BB (see FIG. 5) of one example of a pulley according to a first embodiment of the invention, and a reference curve, FIG. 8*a* schematically depicts a section of a pulley, according to a second embodiment of the invention, in a plane formed by a lateral face of the first fairing element coming into contact with the pulley (equivalent to the plane M in FIG. 5), comprising the point of contact with the pulley.

FIG. 7 depicts a cross section of the pulley P of FIG. 5 in the radial plane BB of the pulley P, in the case where the pulley P is a pulley according to one preferred embodiment of the invention. A radial plane of a pulley is a plane which is formed by a radius r of the pulley and the axis xp of the pulley about which the pulley pivots. The radius r has a length R.

The first groove 24 is delimited by a first surface of which the cross section in the radial plane BB is the first concave curve 25 (U-shaped curve depicted in bold in FIG. 7). The first concave curve 25 comprises a bottom 26 of the first groove 24. The bottom is the point of the first groove 24 which is closest to the axis xp of the pulley.

FIG. 7 also depicts a V-shaped reference curve 28. The V-shaped reference curve 28 is the cross section, in the radial plane BB, of a second curved surface delimiting a second, reference, groove 29 or virtual second groove. The bottom of the second groove, namely the bottom of the reference groove 28 is the bottom 26. The bottom V is the point of intersection of the two branches 31, 32 of the V.

According to the invention, the aperture of the V, $\alpha v$, is at least equal to twice a threshold angle as, and the width of the V lv, measured along a straight line d parallel to the axis of the pulley, is at least equal to a threshold width ls, given by:

$$ls = 0.7 * \text{lid}$$

-continued where $$lid = 2(LC + E) * \sin(\alpha s)$$

$$\alpha s = \alpha i * \frac{R}{R - CAR}$$

lid is an ideal width of the V, where αi is a limit angle greater than 45° and less than 90°, where R is the radius of the pulley and where CAR (indicated in FIG. 4*a*) is the maximum length, separating the trailing edge BF of the fairing elements of the fairing from the axis of the cable, measured parallel to the chord CO of the fairing elements, where LC is the chord length of the fairing elements and E is the maximum thickness of the fairing elements.

In one preferred embodiment of the invention, the width of the V is at least equal to lid. The turnover is therefore accomplished more easily.

Advantageously, the limit angle αi is given by the following formula:

$$\alpha i = \pi/4 + \frac{1}{2}\text{Arctan}(Cf)$$

where Cf is the coefficient of friction between the material that forms the exterior part of the tail of the fairing element and the material that forms the surface delimiting the groove of the pulley. The material that forms the exterior part of the tail of the pulley is the material that forms the fairing element when the fairing element is made from a single material.

In the embodiment of FIG. 7, the first curve 25 coincides with the second curve 28 at the endpoints 33, 34 of the second curve 28. The endpoints 33, 34 of the second curve are the points on the second curve which are spaced apart by the width lv along a straight line parallel to the axis of the pulley xp. They delimit the first groove and the second groove along an axis parallel to the axis of the pulley and along an axis parallel to the radius of the pulley passing through the bottom 26. The first curve 25 is, at every point comprised between each of the endpoint 33, 34 and the bottom 26, coincident with the second curve or closer to the axis of the pulley xp than the second curve along the radius of the pulley in the plane of section BB.

As a result, in order to ensure the desired turnover, the first concave curve 25 delimiting the first groove 24 may have the profile visible in FIG. 7, or alternatively may, between the endpoints, at any point other than the bottom and the endpoints 33, 34, lie below the curve 28 and at least at a distance from the axis that is equal to the distance separating the bottom of the pulley from the axis of the pulley (radius R of the pulley). In other words, the first concave curve, at all points, lies in the space delimited by the curve 28, the straight line dl parallel to the axis passing through the bottom 26 and the straight lines d3 and d4 which are parallel to the radius R of the pulley passing through the points 33 and 34.

The first concave curve 25 is the curve delimiting the first groove 24 intended to receive the faired cable in a radial plane (see FIG. 7).

Figure 14:
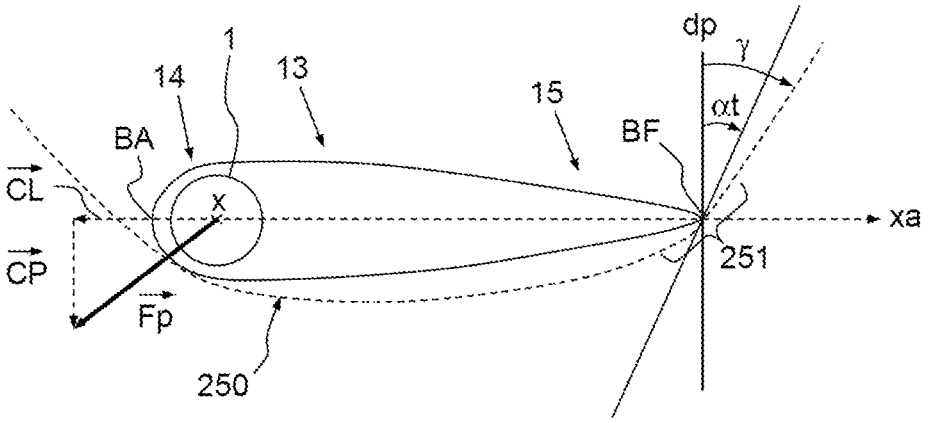
FIG. 14 depicts, in a radial plane of the pulley, a portion of a concave first curve complying with an advantageous feature of the invention.

FIG. 14 depicts, in dotted line, in a radial plane, a portion 250 of a concave first curve complying with an advantageous feature of the invention. The fairing element 13 extends with its leading edge perpendicular to the radial plane. This feature is as follows: the concave first curve is defined in a radial plane BB of the pulley such that, when the fairing element extends with the leading edge BA perpendicular to the radial plane BB, whatever the position of a fairing element in the first groove 24, when the nose 14 of the fairing element 13 is bearing on the concave first curve and the cable 1 is exerting on the fairing element 13, in the radial plane, a force to press the nose of the fairing element against the pulley, said pressing force Fp comprising a component CP perpendicular to the axis of the pulley and a lateral component CL (which means to say a component parallel to the axis of the pulley), the trailing edge BF of the fairing element 13 is not in contact with the concave first curve or is in contact with a part 251 of the concave first curve that forms, with a straight line dp of the radial plane perpendicular to the axis xa extending from the axis of the cable x as far as the trailing edge of the fairing element, an angle γ that is at least equal to an angle of slip at. The angle of slip is given by the following formula:

$$\alpha t = \text{Arctan}(Cf)$$

This feature makes it possible to prevent the fairing element from blocking the cable in the groove when the cable moves laterally in the groove, namely when it moves parallel to the axis of the pulley. What happens is that if this angular condition is respected, the fairing element can be sure of slipping in the event of lateral thrust from the cable. In other words, a pulley having a profile as defined with reference to FIG. 14 makes it possible to ensure that the fairing element will flip from a turned-over position into an acceptable position.

The concave first curve 25 and, therefore, the profile of the first groove, is obtained by those skilled in the art by simulations starting from this definition.

Figure 15:
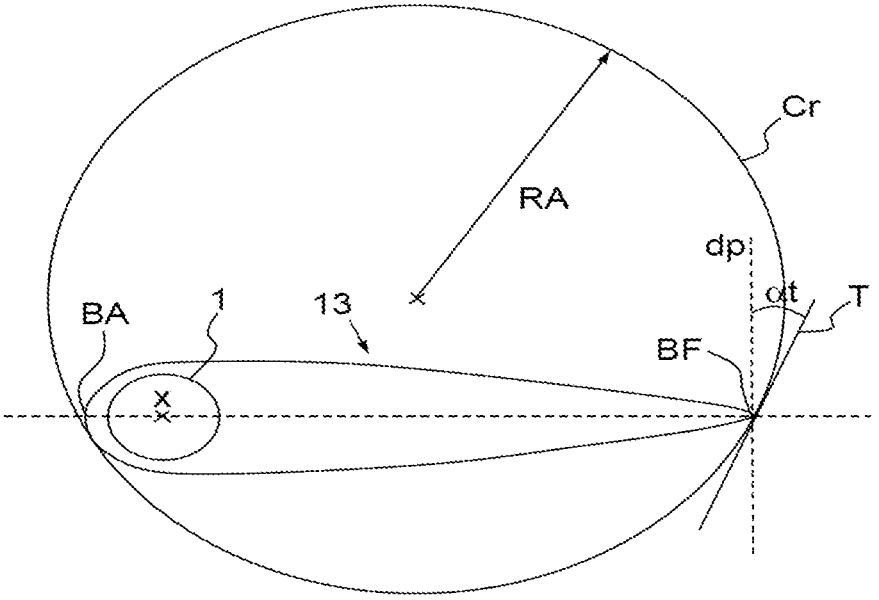
FIG. 15 depicts a circle constructed with respect to a fairing element and satisfying the advantageous feature of the invention.

In practice, for an angle at of the order of 10°, a first curve forming a curved line having at every point a radius of curvature at least equal to half the chord length LC of the fairing element makes it possible to ensure that the fairing element will slip in the event of lateral thrust from the cable. A curved line is a line that has no sharp or salient angle (in the mathematical sense of the term). Specifically, if, as can be seen in FIG. 15, a circle Cr is plotted that passes through the nose 14 of the fairing element 13 and the trailing edge BF of the fairing element 13, with a tangent T at the trailing edge forming an angle at with the straight line dp, the radius RA of this circle is approximately equal to 55% of the chord length LC of the fairing element, which is greater than the value of 50% adopted hereinabove.

Advantageously, the dimensions and shape of the first groove profile are determined to allow the flipping of a reference fairing element of maximum length CAR, measured parallel to the chord separating the trailing edge BF of the fairing elements of the fairing, a fairing element chord length LC and a maximum thickness E, and possibly also as a function of the coefficient of friction Cf between the reference fairing element and the pulley. These dimensions and profile are advantageously defined to ensure that the fairing element flips from a turned-over position into an acceptable position between without deforming this reference fairing element.

In the embodiment of FIG. 7, the width of the first groove lgb is equal to the width of the V, lv. As an alternative, the first groove extends beyond the endpoints. It may comprise the groove of the pulley only or comprise the groove of the pulley and be delimited, on each side of the pulley, by deflectors or cheeks that are vertical (which means to say perpendicular to the axis of the pulley) or substantially vertical. The first groove may also be the groove of the pulley which, beyond the V or above the V comprises walls that are vertical (which means to say perpendicular to the axis of the pulley) or substantially vertical. The walls and cheeks as defined make it possible to prevent the cable from leaving the first groove in the event of lateral movement.

In the embodiment of FIG. 7, the first groove is the groove 24 of the pulley. As an alternative, the first groove comprises the groove of the pulley. The bottom of the first groove is the bottom of the groove of the pulley. By contrast, the first groove extends beyond the groove of the pulley. It is, for example, delimited at least on one side of the pulley with respect to a plane perpendicular to the axis of the pulley, by a deflector or a cheek. The defector or cheek may be fixed with respect to the pulley or able to rotate with respect to the pulley about the axis of the pulley. Advantageously, the first groove comprises lateral edges making it possible to limit the lateral movement of the cable. The lateral edges may extend completely within the part situated between the two endpoints or alternatively partially and extend also partially beyond these points.

The pulley, and more specifically the groove of the pulley, has a profile that is constant. In other words, it is the same in all the radial planes of the pulley.

The first curve 25 and the second curve 28 are symmetric with respect to a plane perpendicular to the axis xp of the pulley and comprising a radius of the pulley passing through the bottom 26. This plane is then the median plane of the groove.

Figure 8A:
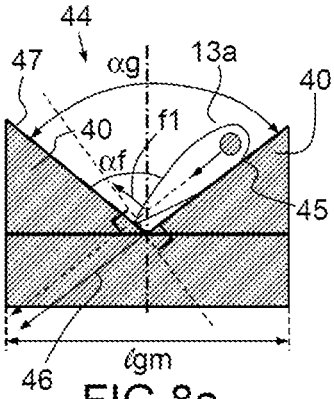
Figure 8B:
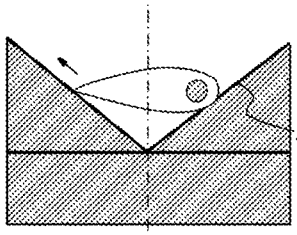
Figure 8C:
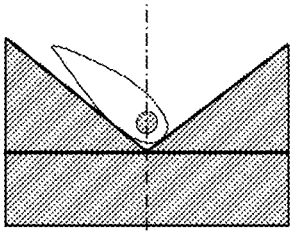

The way in which the pulley profile according to the invention as depicted in FIG. 7 is obtained will now be explained in greater detail. The applicant started from the observation that the V of FIG. 6*a* needs to be opened out so that the tail can move clear to the side as the cable is being wound in. FIG. 8*a* depicts a partial cross section of a pulley 40 according to a second embodiment, in the plane M which is a plane formed by a lateral face 18 of the head-end fairing element 13*a* of the segment 12*b* coming into contact with the pulley. The lateral face comprises the point of the fairing element that is first to come into contact with the pulley. The pulley has an open V-shaped profile making it possible to achieve turnover. In this figure, the pulley 40 has a V-shaped groove 44. The notable fairing element 13*a* is resting against a first branch 45 of the V, with a leading edge facing toward the bottom 46 of the groove 44. The groove aperture $\alpha g$ is such that the angle formed between the line of action of the force (depicted by the arrow indicated in the fairing element) and the second branch 47, $\alpha f$, is greater than 90°. In this case, the tail has been given a clearance path which allows it to turn over in the direction of the arrows indicated in FIG. 8*a* to adopt the position depicted in FIG. 8*c* while passing via the position depicted in FIG. 8*b* following the movement indicated by the arrows by pivoting about the axis of the cable under the action of the tension of the cable (which is exerted along the line of action of the force) when the cable is hauled along the groove. As visible in FIG. 8*a*, the direction of the line of action of the force is substantially parallel to the first branch 45. This is why the aperture of the V $\alpha g$ in the plane M, which is at least equal to twice the limit angle $\alpha i$ is substantially equal to $\alpha f$. As a result, the aperture of the V $\alpha g$ is greater than 90°. To take account of friction between the tail of the fairing element and the surface of the groove, the limit aperture $\alpha g=2*\alpha i$ is at least equal to 95° and preferably at least equal to 100°.

The angular feature is not enough to obtain correct overturning of the fairing elements. It is necessary for the width of the groove lgm, in the plane M, to be at least equal to a limit width li which is given by the following formula:

$$li=2(LC+E)*\sin \alpha i$$

Now, as can be seen in FIG. 5, the profile of the groove of the pulley in the plane BB is the projection, onto a plane that makes an angle β with the plane M, of the profile of the groove in the plane M. The angle β is dependent on the length CAR which is the maximum length separating the trailing edge BF of the fairing elements of the fairing from the axis of the cable measured parallel to the chord CO of the fairing element 13*a*. It is defined as follows:

$$CAR = R - R\cos\beta$$

$$CAR = R(1-\cos\beta)$$

$$\beta = \arccos\left(1 - \frac{CAR}{R}\right)$$

The V previously defined is therefore to be corrected by the bias introduced by the angle β. The aperture $\alpha v$ of the V formed by the second curve 28 in the plane BB is at least equal to a threshold angle as. The threshold angle as is given by the following formula:

$$\alpha s = \frac{\alpha i}{\cos\beta}$$

Hence $$\alpha s = \alpha i * \frac{R}{R - CAR}$$

Therefore, the width of the V lv in the plane BB is at least equal to the ideal width lid given by the following formula:

$$lid=2(LC+E)*\sin \alpha s$$

The first curve 25 delimiting the first groove 24 has, at least from the first endpoint 33 to the second endpoint 34, a concave shape.

Figure 9A:
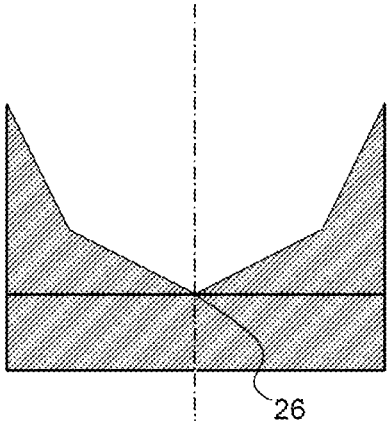
FIGS. 9*a* and 9*b* depict sections, on radial planes, of two examples of pulleys according to a third embodiment, FIG. 10 schematically depicts, in a plane BB, lower and upper curves of a first bathtub curve.
Figure 9B:
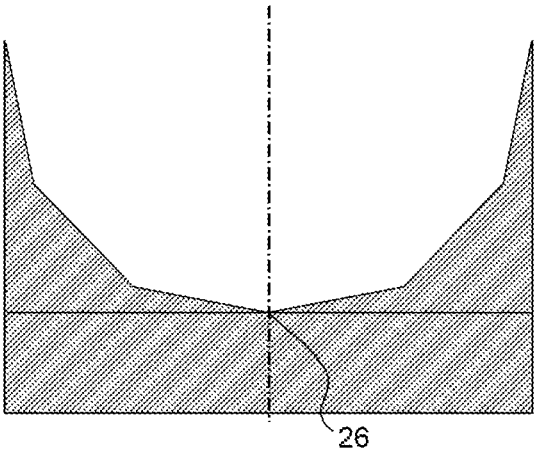
Figure 10:
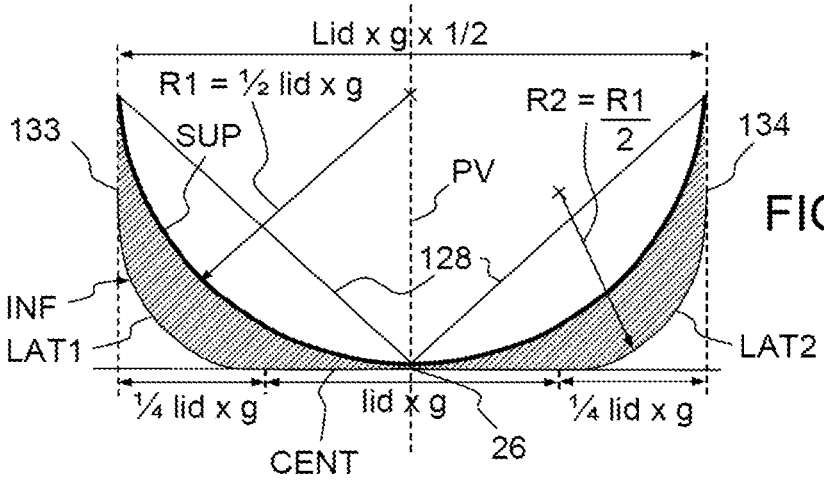

It may, at least from the first endpoint 33 as far as the second endpoint 34 have a V shape or alternatively exhibit several sharp or salient angles AS depicted in FIGS. 9*a* and 9*b*. In other words, the curve substantially forms a broken line. In these figures, the curves exhibit a sharp or salient angle in the region of the bottom 26 and are symmetric with respect to the plane perpendicular to the axis of the pulley and comprising a radius of the pulley. These profiles perform better at turning over the fairing elements than does the V-shaped profile. These profiles are advantageously, although not necessarily, symmetric with respect to a plane perpendicular to the axis of the pulley passing through the bottom 26. As an alternative, the first curve has sharp or salient angles and has a tangent substantially parallel to the axis of the pulley xp at the bottom. The bottom is then the point on the curve situated on the median plane of the groove.

Advantageously, as depicted in FIG. 7, the first curve 25 is, between the endpoints 33, 34, a curved line. In other words, this is a concave curve with no sharp or salient angle (within the mathematical meaning of the term). Mention is made of a U-shaped profile. What this means is that the curve substantially never has more than one tangent at any one point. Its derivative is substantially continuous.

When the first groove (or first curve) has a V-shaped cross section (V-shaped first curve) it needs to have a width at least equal to lid for turnover to be guaranteed. When the first groove (or first curve) has a cross section such that the first curve is U-shaped, then it can have a smaller width potentially down to 0.7*lid, because it has no sharp angles in which the tail of the fairing element may jam. In that case, the aperture of the V may also be below the threshold angle. In other words, the V needs to have a width at least equal to 0.7*lid. By contrast, overturning may prove more difficult than when the V has a width at least equal to lid. Below this threshold, there is no certainty that overturning will occur.

Advantageously, in the case of a first groove having a U-shaped profile, the first groove has a bathtub-shaped bottom. The groove with a bathtub-shaped bottom offers the advantage of ensuring certain and fluid reorientation of the fairing element and allows the fairing element to be oriented in a substantially lying-down position in the bottom of the groove.

That means that the first curve has a central zone, this central zone has a width equal to g*lid, where lid is the ideal width and g is comprised between 0.7 and 1, between the endpoints coinciding with the endpoints of a V-shaped reference curve 128 having a width equal to g*lid. The central zone is delimited by the two curves (see hatched zone) 10:

- an upper curve SUP having a first radius of curvature R1 radius equal to ½*g*lid passing through the bottom and the center of which is situated on a straight line perpendicular to the axis of the pulley passing through the bottom,
- a lower curve INF comprising a central portion CENT extending substantially parallel to the axis of the pulley symmetric with respect to a plane perpendicular to the radial plane passing through the bottom and extending, along the axis of the pulley, over a first width equal to ½*g*lid and comprising, on each side of the central portion CENT, lateral portions LAT1 and LAT2 connecting the central portion to the endpoints 133, 134 and having a second radius of curvature R2 equal to ¼*g*lid. Each lateral portion extends over a width equal to ¼*g*lid along the axis of the pulley. The centers of the lateral portions are symmetric with respect to one another about the vertical plane PV passing through the bottom and perpendicular to the axis of the pulley xp.

The central zone may be one of the two curves. The lower curve is the preferred embodiment of the invention.

Advantageously, the central zone of the first curve is formed by a pulley having a groove the width of which is the width of the central zone.

Advantageously, the first curve comprises upper parts extending substantially perpendicularly above the endpoints of the V so as to prevent the cable from leaving the first groove in the event of a vertical movement of the cable. These cheeks are secured to the pulley or belong to the pulley or are fixed with respect to the axis of the pulley.

The first curves comprised between the upper curve and the lower curve offer the advantage of satisfying the angle condition making it possible to prevent the fairing element from inhibiting the lateral movement of the cable.

Figure 11A:
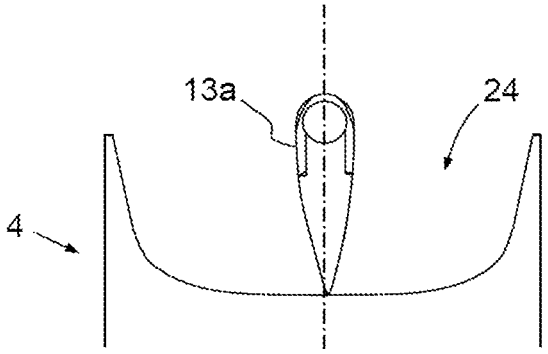
FIGS. 11*a* to 11*c* depict, in successive planes parallel to the plane M, cross sections of the pulley and the orientations successively adopted by the lateral face of the reference fairing element as the cable is wound in, the fairing element arriving at the pulley of FIG. 7 upside down, FIGS. 12*a* to 12*c* schematically depict in side view, a fairing element according to a first embodiment of the invention and a portion of fairing comprising a fairing element according to the invention entering a pulley, in perspective (12*a*), in side view as it enters the pulley (FIG. 12*b*), and viewed in section on the plane M visible in FIG. 12*a*, and viewed in section on the plane Q visible in FIG. 12*d*, FIG. 13 schematically depicts an example of a fairing element according to a second embodiment of the invention.
Figure 11B:
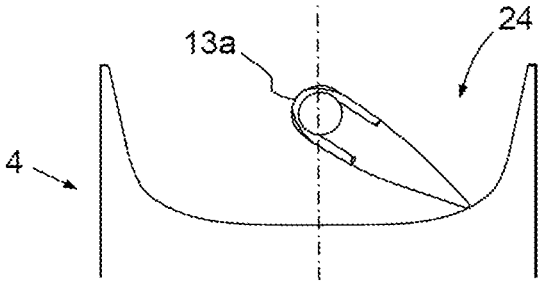
Figure 11C:
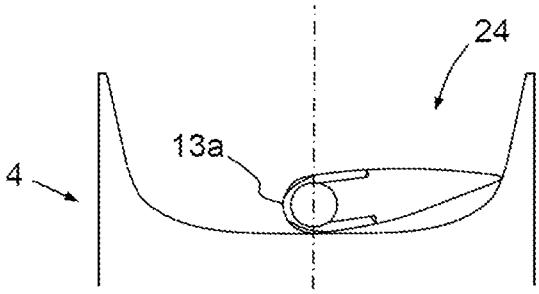

FIGS. 11*a* 11*c* depict, in successive planes parallel to the plane M, the orientations successively adopted by the lateral face of the reference fairing element comprising the first point to come into contact with the pulley, as the cable is being wound in. The fairing element 13*a* arrives with its trailing edge downward (FIG. 11*a* in the plane M) and when the cable is pulled, the element pivots about the axis of the cable (see FIG. 11*b*) under the effect of the tension of the cable, until it reaches the substantially lying-flat position in which the leading edge faces toward the bottom of the groove and the leading edge faces toward the outside of the groove (FIG. 11*c*). This profile makes it possible to facilitate and simplify the flipping of a fairing element because the flattened central portion of the groove of the pulley means that there is a significant distance between the axis of the reaction of the groove of the pulley on the fairing element (the axis leading from the trailing edge toward the center of the portion of circle formed by the central portion) and the axis of rotation of the fairing element (extending along the trailing edge axis—toward the axis of the canal xc or axis of the cable x) because of the significant distance between the axis of the cable and the center of the portion of circle formed by the central portion. This profile also allows the cable and its fairing, which are positioned substantially lying flat, to come and rest without danger against the flanks of the pulley when the cable is urged laterally (namely parallel to the axis of the pulley) if for example the ship changes heading. If the cable and the leading edge of the fairing are positioned on the correct side, they remain there. If they are on the incorrect side, the profile of the pulley allows a gentle near-overturning which allows the cable (which is where the forces are applied) to come and press against the flank of the pulley. This slippage is present but less fluid in the other configurations of pulley.

To sum up, the pulley according to the invention and, more generally, the guide device according to the invention, makes it possible to ensure the straightening of a fairing element coming to bear against the pulley with an orientation in which the trailing edge faces toward the bottom of the groove of the pulley and the leading edge is vertically aligned with the trailing edge. The fairing element carries along with it the fairing elements to which it is connected in rotation about the cable, namely the fairing elements of the same portion. The pulley according to the invention also allows the straightening of the fairing elements of a cable organized into a single portion in which the fairing elements are all joined together in rotation about the cable if an inter-fairing-element connection should break for example under the effect of a double twist, thereby allowing the faired cable to pass through the pulley without deformation of the fairing elements. It also allows the straightening of the head-end fairing element of a fairing comprising a single portion extending over a length shorter than the length of the cable starting from the end that may be immersed. It also allows the straightening of the fairing elements of a faired cable comprising fairing elements which are all free to rotate about the cable independently of one another. It furthermore, because of its width, allows guidance of a cable organized into a single portion exhibiting remnant twist (very tightly twisted immersed torsion not reabsorbed on passing through the pulley) without deformation of the fairing elements, something that is not possible using a narrow V-shaped pulley.

The guide device of the invention is simple and effective because it does not require the fitting of a cable-follower device (namely a device able to follow the cable as it moves laterally and vertically with respect to the pulley).

The pulley according to the invention, and, more generally, the guide device according to the invention, because of its profile, does not turn the fairing element over as far as a situation in which the trailing edge is situated in vertical alignment with the leading edge. For example, in the case of the pulley with a bathtub-shaped bottom, the fairing element is turned over into a position in which it is substantially flat (with the trailing edge raised slightly upwards). It therefore needs to pivot by approximately ¼ of a turn as opposed to ½ of a turn (if it were to have to adopt the position in which the trailing edge was above and in vertical alignment with the leading edge) thereby facilitating the operation whereby the pulley straightens the fairing element.

Advantageously, the guide device comprises, between the winch and the pulley, a straightening device allowing the fairing elements leaving the pulley and heading for the winch to be oriented about the axis of the cable in such a way that they exhibit a predetermined orientation with respect to the drum of the winch, for example with the leading edge downmost and the trailing edge vertically in line with the leading edge. These devices are truly effective only when the position of the cable is perfectly known (which it is as it leaves the pulley).

In the embodiment of FIGS. 4*a* and 4*b*, the fairing elements of the portions have a cross section which is constant, which means to say fixed, along the leading edge. What is meant by cross section is the profile of the fairing element in a transverse plane, namely a plane running perpendicular to the leading edge BA, namely to the axis of the canal xc What is meant by a cross section that is constant is a cross section that exhibits substantially the same shape and the same dimensions in all transverse planes regardless of their positions along the leading edge between the lateral faces 17, 18. In other words, the trailing edge BF is substantially parallel to the leading edge BA across the entire width l of the fairing element. The width l of the fairing element is the distance between the two lateral faces 17, 18 along an axis parallel to the leading edge BA.

The trailing edge BF constitutes a bearing edge parallel to the leading edge BA.

Figure 12A:
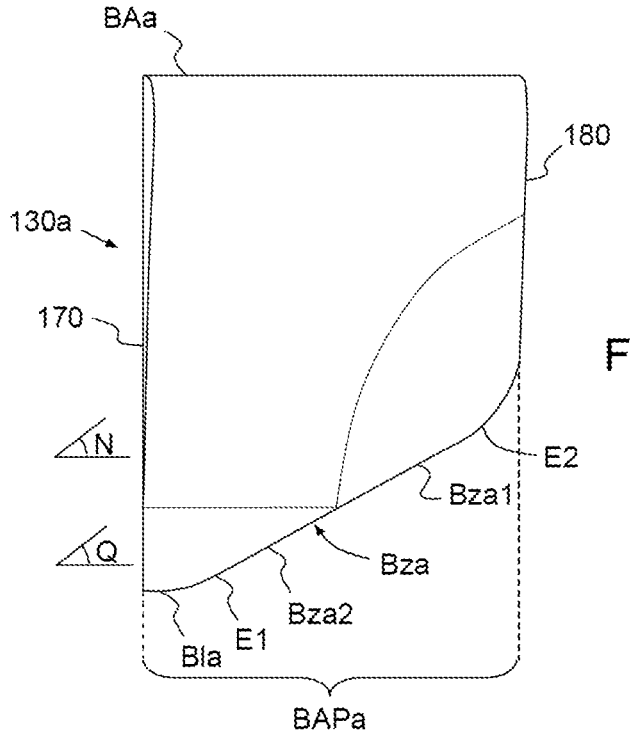
Figure 12B:
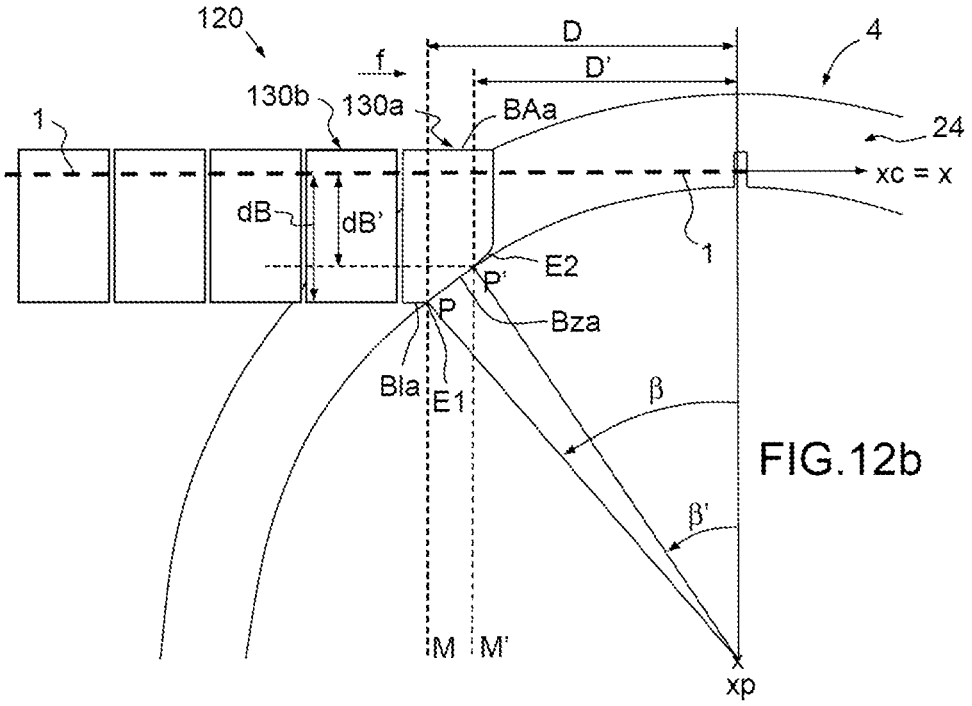
Figure 12C:
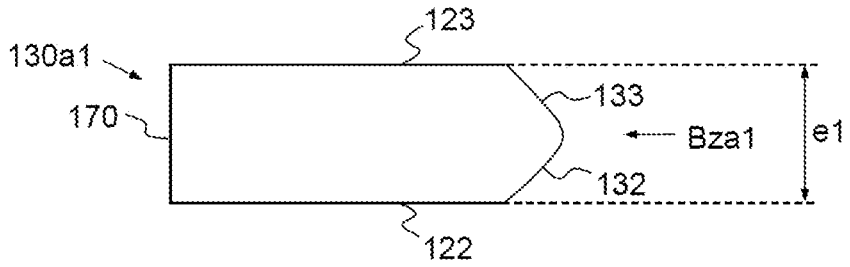

As an alternative, as visible in FIGS. 12*a* to 12*c*, at least one fairing element 130 of the fairing is a mitered fairing element. A mitered fairing element is a fairing element which comprises a bearing edge BAPa comprising a first bearing edge Bza which is mitered with respect to the leading edge BAa, the miter being produced in such a way that the distance between the leading edge BAa and the mitered first bearing edge Bza, along an axis perpendicular to the leading edge BAa, and to the axis xc of the canal 16, varies linearly along the axis xc. What is meant by a first bearing edge Bza that is mitered is a first bearing edge Bza which extends longitudinally substantially along a straight line which is angled or inclined with respect to the leading edge BAa. The first bearing edge Bza extends longitudinally in a first plane containing a plane or parallel to a plane defined by the leading edge BAa and the chord CO of the fairing element. In other words, the first bearing edge Bza is at an angle with respect to the leading edge BAa in this first plane.

The bearing edge BAPa extends longitudinally between two ends E1 and E2. The bearing edge BAPa is arranged in such a way that the distance between the bearing edge BAPa and the leading edge BAa decreases continuously, from a first end E1 of the first bearing edge Bza to a first lateral face 180 of the fairing element closer to the second to the first bearing edge Bza than to the first end of the bearing edge, along an axis parallel to the leading edge BA.

In the embodiment of FIG. 12*b*, this lateral face 180 is the lateral face of the fairing element 130*a* furthest away from the free end 6 of the cable (visible in FIG. 2) in the opposite direction to the arrow f. The other lateral face 170 is the lateral face of the fairing element 130*a* closest to the free end 6 of the cable. This feature makes it easier to turn the fairing element 130 over when it comes to bear against the pulley via its trailing edge, as the cable is being wound in, namely as the cable is being pulled with respect to the axis of the pulley xp, in the direction of the arrow f. Specifically, FIG. 12*b* depicts the position P', on the pulley 4 of FIG. 7, of the point at which the fairing element 130*a* comes into contact with the pulley 4 as a result of the traction of the cable with respect to the axis of the pulley xp in the direction of the arrow. This point is situated at a distance B' (indicated in FIG. 12*b*) from the cable 1 perpendicular to the axis of the cable x. Also depicted is the position P, on the pulley 4, of the point at which a fairing element 13 that would have had the shape depicted in FIGS. 4*a* and 4*b* would have come into contact with the pulley P. This point is situated at a distance dB from the cable 1 perpendicular to the axis of the cable x. The distance dB' is less than the distance dB, which means that the overturning of the fairing element is easier and therefore that the overturning of the fairing elements of the portion is also easier. This is valid for the pulley of the invention but is also valid for any guide device, particularly of the type that allows the orientation of the fairing element with respect to the guide device to be modified by rotating action of the fairing element about the axis of the cable. In particular, the mitered bearing edge makes it easier to reorient a fairing element in any guide device that allows the orientation of the fairing element with respect to the guide device to be modified by rotating action of the fairing element about the axis of the cable (or of the canal) when the fairing element comes to bear against a bearing surface of the guide device via the bearing edge. In other words, the mitered bearing edge in particular facilitates the reorientation of the fairing element by any guide device comprising a surface that opposes the traction of the faired cable as the cable is being wound in or paid out. The invention works for example with guide devices that are able to follow the cable in the event of lateral and/or vertical movement of the cable. In general, the presence of a mitered fairing element makes it possible to limit the risks of damage to the fairing, notably in the presence of a double twist, by facilitating the flipping of a fairing element as it enters a guide device, thereby limiting the risks of the fairing becoming jammed in the guide device.

This embodiment also offers an advantage in the case of a pulley of constant profile, and more particularly a pulley according to the invention. Specifically, the point of contact P' is situated in a plane M' situated at a shorter distance D' than the distance D at which the plane M (comprising the point P) is situated, with respect to the axis of the pulley, parallel to the axis of the cable x. As a result, the groove of the pulley is not as deep in the plane M' as in the plane M. Specifically, the profile of the groove in the plane M (or M') is the projection of the profile of the groove in a radial plane passing through the plane P (or respectively P') onto the plane M (or, respectively, M') forming an angle β (or respectively β' less than β) with the radial plane at the point considered. Now, the fact that the groove is not as deep in the plane M' as it is in the plane M means that the pulley is flatter in the plane M than in the plane M', at least at the bottom (namely at the level of the central part of the curve delimiting the groove). If the fairing element comes into contact with the central portion of the pulley in the bottom of the bathtub, the central portion is flatter in the plane M' than in the plane M, or in other words, the radius of the contact surface at the point P is greater in the plane M' than in the plane M, making it easier for the fairing element to flip under the effect of the traction of the cable with respect to the axis of the pulley.

In the embodiment of FIG. 12*b*, the mitered fairing element comprising the miter is the fairing element 130*a* at the head-end of the portion, namely the fairing element furthest from the end of the cable that may be immersed. That makes it possible to facilitate the flipping of the fairing element 130*a* during the winding-in of the cable and to facilitate the flipping of the entire portion 120 because, since the fairing element is connected in terms of rotation about the cable to the other fairing elements of the portion, as it moves about the cable it carries all the fairing elements of the portion 120 along with it. The head-end fairing element 130*a* is a fairing element which is adjacent to just one other fairing element 130*b* belonging to the same portion 120. The first bearing edge Bza of the head-end fairing element 130*a* is arranged in such a way that the distance between the leading edge BAa and the first mitered bearing edge Bza decreases continuously, along an axis parallel to the leading edge BAa, from a first end E1 of the first bearing edge Bza to a second end E2 of the first bearing edge Bza, further away from the other fairing element 130*b* than the first end E1, along the axis parallel to the leading edge BAa.

As an alternative, the mitered fairing element is the fairing element at the tail-end of the portion, namely the fairing element closest to the end of the cable that may be immersed. That makes it possible to facilitate the flipping of the fairing element during the paying-out of the cable (when the fairing element comes to bear on the pulley on the other side of the pulley with respect to the axis of the pulley) and to facilitate the flipping of the entire portion because the fairing element (by a propagation of the rotational movement over the entire portion). The tail-end fairing element is a fairing element which is adjacent to just one other fairing element belonging to the same portion. The first bearing edge is arranged in such a way that the distance between the leading edge BAa and the first mitered bearing edge decreases, along the leading edge BAa, from a first end of the first bearing edge facing the other fairing element to a second of the first bearing edge further away from the other fairing element, along the axis parallel to BAa. The other end of the first bearing edge is closer to a lateral face than the first end of the bearing edge. This embodiment, like the preceding one, makes it possible to ensure the flipping of all the fairing elements of the portions of fairing without having to provide only mitered fairing elements over the entire fairing, as so doing would have the effect of limiting the performance of the fairing in terms of drag reduction.

Advantageously, each portion comprises at least one (head or tail) end fairing element comprising a mitered edge. The other fairing elements are not mitered fairing elements. They do not have a mitered first bearing edge. The bearing edge is the trailing edge and is substantially parallel to the leading edge over its entire length.

In an alternative form, a fairing comprising a single portion as defined above may comprise a fairing element with a mitered bearing edge. This portion extends for example over a length less than the length of the cable starting from the end that may be immersed. In this case, the head-end fairing element of the portion is advantageously a fairing element comprising a mitered bearing edge designed as for the head-end fairing element described hereinabove.

In another alternative form, the portion extends over the entire length of the cable.

In all the configurations of fairing (of the type comprising one portion, several portions or comprising fairing elements which are all free to rotate independently of one another about the elongate element), all the fairing elements could be mitered fairing elements. That would make it easier to flip each fairing element in the event of a breakage of an inter-fairing-element connection downstream of the fairing element as seen from the pulley, when the fairing elements are initially connected. In cases where the fairing elements are free to rotate independently of one another, that would make it easier to flip each fairing element as it arrives on a guide device. More generally, the mitered fairing element makes it possible to avoid the need to join the fairing elements together and therefore makes it possible to limit the cost of the fairing and the time taken to assemble the fairing.

If there is a wish to reorient the fairing elements when the cable is being wound in, the miter is produced in such a way that the distance between the leading edge BA and the first mitered bearing edge decreases, along the axis xc, from the end of the first bearing edge closest to the end of the cable may be immersed as far as the end of the bearing edge opposite to the end of the cable that may be immersed and vice versa if the wish is to facilitate the flipping during the paying-out of the cable.

In the embodiment of FIGS. 12*a* and 12*b*, the bearing edge BAPa is the trailing edge BF. It comprises the first mitered bearing edge Bza and a second bearing edge Bla which runs parallel to the axis x and is situated a fixed distance away from the leading edge along the axis x. The first mitered bearing edge is connected to the lateral face 180 and to the second bearing edge Bla in the direction of the leading edge, by fillet radii or chamfers. The maximum chord length LC is the distance between this second bearing edge Bla and the leading edge. As an alternative, the leading edge has no second bearing edge Bla extending parallel to the axis x. The miter extends substantially over the entire width of the fairing element and is advantageously, although not necessarily, connected to the lateral faces by fillet radii or chamfers.

Figure 12D:
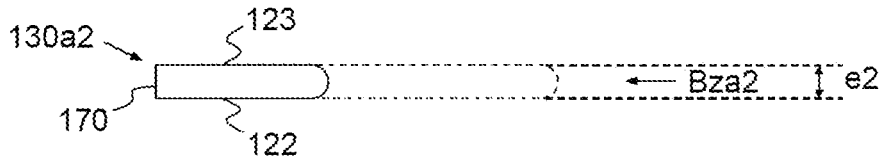

As visible in FIGS. 12*c* and 12*d* which depict cross sections of the fairing element on respective planes N and Q, depicted in FIG. 12*a*, parallel to the leading edge and perpendicular to the lateral faces 170, 180, the fairing element comprises a thick first portion 130*a*1 visible in FIG. 12*c* and a thin second portion 130*a*2 having a second thickness e2 smaller than the first thickness e1 of the thick part. The second thickness e2 is substantially equal to the thickness of the tail end 15 opposite to the end of the tail that is connected to the nose 14 of the fairing element. The first edge comprises a first portion Bza1 extending into the thick first portion 130*a*1 of the fairing element and a second portion Bza2 extending into the thin part. The first portion of the first bearing edge Bza1 is connected to the longitudinal faces 122, 123 by respective chamfers 132, 133. In other words, the fairing element comprises chamfers connecting the first portion of the first bearing edge Bza1 to the respective longitudinal faces 122, 123. That means that the trailing edge can be made thinner in the thick part of the fairing element, thereby limiting the risks of the fairing element becoming jammed on the guide device. As an alternative, the chamfers extend over the entire length of the first bearing edge.

As an alternative, the first portion of the leading edge Bza1 is connected to the lateral faces by respective bulging surfaces. What is meant by bulging surfaces is surfaces with convex curvature. This embodiment also makes it possible to limit the thickness of the bearing edge. As an alternative, the curved surfaces extend over the entire length of the first bearing edge. The chamfers and curved surfaces are two nonlimiting technical solutions that make it possible to obtain the feature whereby at least a first portion of the first bearing edge Bza1 has a thickness less than the thickness e1 of the fairing element in any longitudinal plane parallel to the leading edge and perpendicular to the lateral faces of the fairing element intersecting the first portion of the first bearing edge Bza1. The thickness of the fairing element in a plane of section is the distance separating the first longitudinal face 122 from the second longitudinal face 123 in a direction perpendicular to the chord CO in the plane of section of the fairing element. Advantageously, the first portion Bza1 has the same thickness as the second bearing edge Bla which runs parallel to the axis x and is situated a fixed distance away from the leading edge along the axis x.

A bearing edge of a fairing element according to a second embodiment of the invention will now be described with reference to FIG. 13. Everything already stated regarding the installation of the fairing element on a fairing, the configuration of the fairing, the thickness of the bearing edge and the arrangement between the first bearing edge and the second bearing edge remains valid.

Figure 13:
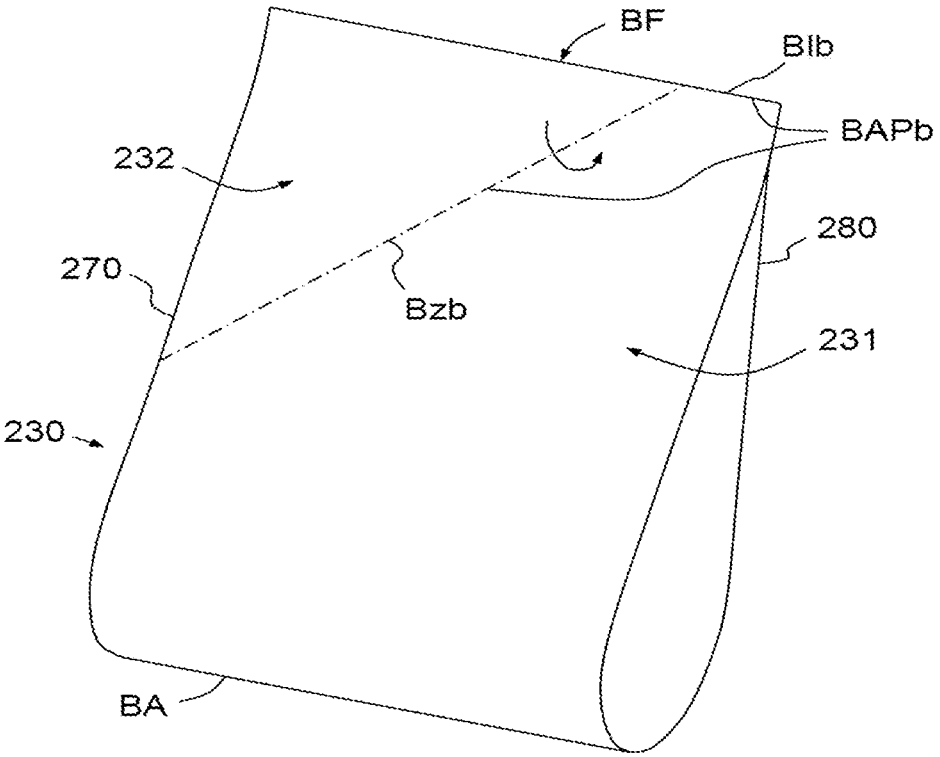

In a second embodiment one example of which is depicted in FIG. 13, the fairing element 230 comprises two parts 231, 232 connected together along the first bearing edge Bzb in such a way that the fairing element 230 can pass from a deployed position in which the trailing edge BF is parallel to the leading edge BA to a folded configuration in which the fairing element is folded along the first bearing edge Bzb. In other words, the folding of the fairing element is a miter fold. What is meant by folding along the first bearing edge is a folding along the first bearing edge, namely in the direction of the length of the bearing edge. In other words, the fairing element may be in a deployed configuration visible in FIG. 13, in which the first part 231 and the second part 232 are substantially coplanar, namely extend mainly in a plane passing through the trailing edge and the leading edge, to a folded position in which the two parts are no longer coplanar and the trailing edge is no longer parallel to the leading edge. The fairing element exhibits better hydrodynamic performance than a fairing element truncated along the bearing edge. Moreover, the progress of the fairing element over the pulley is facilitated as we shall see.

Advantageously, the fairing element is configured so as to be foldable reversibly about the first bearing edge Bzb. The fairing element reverts naturally from the deployed configuration to the folded configuration when the torque returns to the threshold value or to a value below the threshold. Advantageously, the fairing element is configured to be folded reversibly when it passes from the overturned position (trailing edge downward) to the acceptable position on the pulley. These advantages are obtained for example obtained the choice of the materials for the fairing element, their shape, their arrangement, their dimensions.

In FIG. 13, the bearing edge BAPb connects the two lateral faces 270, 280. The fairing element 230 is formed of two parts 231, 232 back to back along the first mitered bearing edge Bzb. The fairing element is configured to be kept substantially in a deployed configuration (visible in FIG. 13) when subjected to the hydrodynamic flow of the water, in which configuration the two parts 231, 232 are arranged, relative to one another about the first bearing edge, in such a way that the fairing element has a trailing edge parallel to the leading edge and a cross section that is constant along the leading edge. In other words, the length of the chord CO is constant. As an alternative, the cross section of the fairing element can vary along the leading edge. The cross section of the fairing element is the shape of the cross section of the fairing element in a plane perpendicular to the leading edge. The fairing element is kept in the deployed position as long as the torque inducing relative pivoting between the two parts about an axis formed by the first bearing edge Bzb is less than or equal to a predetermined threshold. The longitudinal direction of the first bearing edge is the direction of the axis formed by the bearing edge. The threshold is predetermined for the design of the fairing element. The threshold is, for example, higher than a nominal torque, that may be applied by the hydrodynamic stream of water on the fairing element when the fairing element is immersed and possibly being towed along the trailing edge—leading edge axis. The nominal torque the maximum torque to be exerted by the hydrodynamic stream of water for a nominal maximum speed at which the fairing element may be towed and in a sea state exhibiting a maximum nominal force. That allows good hydrodynamic properties to be maintained. As an alternative, the threshold is below the nominal torque. The fairing element is also configured to allow relative pivoting between the two parts 231, 232 about the first bearing edge Bzb (see arrow) when a torque inducing relative pivoting between the two parts 231, 232, applied about the axis formed by the first bearing edge Bzb, exceeds the threshold so that the end fairing element passes from the deployed configuration into a configuration folded about the bearing edge. The axis formed by the first bearing edge is an axis contained in the first bearing edge and parallel to the longitudinal axis of the first bearing edge. In the folded configuration, the fairing element does not have a constant cross section and the trailing edge is not parallel to the leading edge over its entire length. In the folded position, the fairing element is folded along the first bearing edge Bzb. In the deployed position, the fairing element is unfolded. This embodiment makes it possible to limit or avoid reductions in performance in terms of the reduction of the hydrodynamic drag of the fairing element while at the same time facilitating the progress of the fairing element through the pulley and the overturning of this element.

The first part 231 extends for example on one side of the first bearing edge and is delimited by the first bearing edge Bzb, the second bearing edge (if there is one) Blb, the leading edge BA, one lateral face 280 and the portion of the other lateral face 270 extending between the leading edge BA and the first bearing edge Bzb.

The second part 232 is for example delimited by the first bearing edge Bzb, the part of the first lateral face 270 extending from Bzb as far as the trailing edge BF and the part of the trailing edge BF situated between Bzb and the first lateral face 270. In other words, the first part is the part that comprises the leading edge BA and the second part is the other part.

In the particular example of FIG. 13, the first part 231 is, for example, made from a material that is rigid and the second part 232 is made from a material that is flexible or soft and does not deform appreciably when the torque inducing relative pivoting of the two parts about the first bearing edge is less than or equal to the threshold and which does bend when the torque exceeds the threshold, notably when the point of intersection between the trailing edge and the first lateral face 270 comes into abutment against a guide device. In general, the first part has a stiffness greater than that of the second part so that the fairing element passes from the deployed configuration into the folded configuration by folding of the second part 232. The deformation of the second part is elastic so as to obtain reversibility.

The second part may, for example, be made of polyurethane. The first part may be made of a polyurethane with a rigidity higher than that of the material of the second part or alternatively may be made of POM or of PET.

Figure 16A:
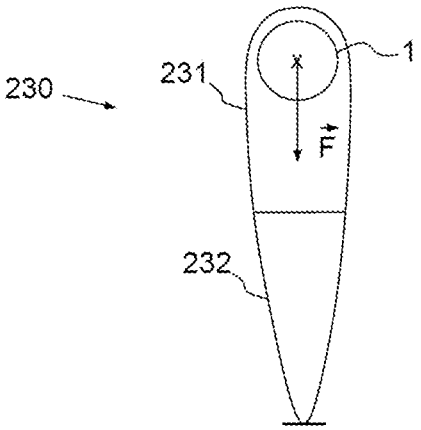
—FIGS. 16*a* to 16*c* depict schematically in cross section along a transverse wall, a fairing element of FIG. 13 in three successive situations when the fairing element is bearing against the pulley and pulled toward the pulley.
Figure 16B:
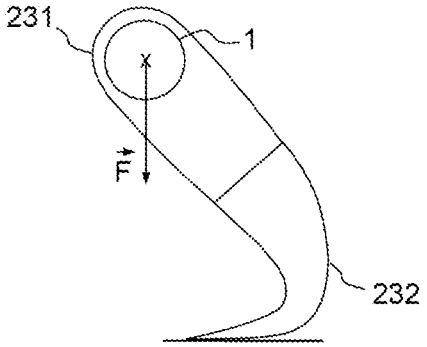
Figure 16C:
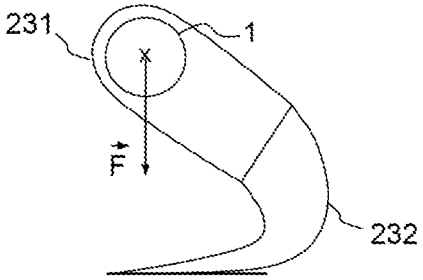

Advantageously, the second part is made from a homogenous material. This then gives rise to progressive folding of the second part along a main fold line which starts at the junction between the lateral face 270 and the trailing edge BF and which continuously moves closer to the first bearing edge Bzb as the fairing element advances in the groove of the pulley, the folding always continuing as far as the first bearing edge as depicted in FIGS. 16*a* to 16*c*. When the fairing element comes into abutment with the pulley or the guide device, the cable 1 exerts a downward vertical force F on the fairing element. The point of contact between the fairing element and the pulley is situated in vertical alignment with the cable. The fairing element has trouble sliding on the pulley. As the fairing element folds, the point at which the fairing element bears against the pulley shifts from vertical alignment with the cable and this has the effect of encouraging the fairing element to slip on the pulley.

Figure 17A:
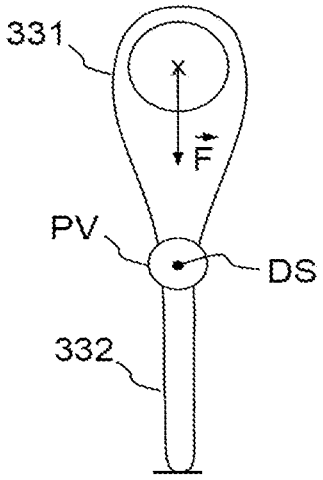
FIGS. 17*a* to 17*c* depict, schematically in cross section along a transverse wall, another example of a fairing element according to the second embodiment in three successive situations when the fairing element is bearing against the pulley and pulled toward the pulley, From one figure to another, the same elements bear the same references.
Figure 17B:
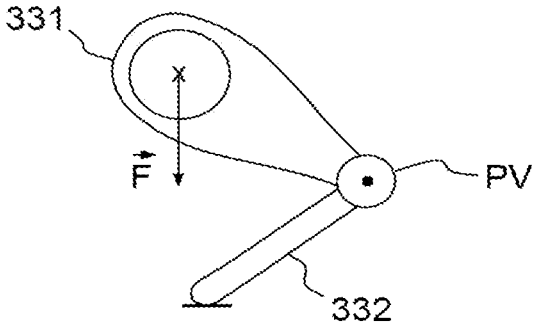
Figure 17C:
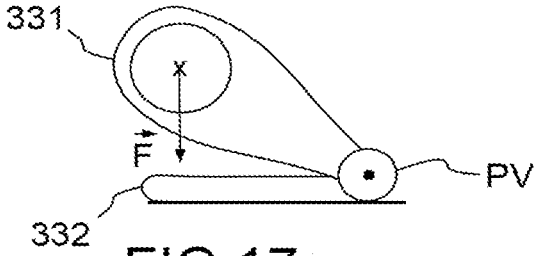

In an alternative form of the second embodiment, depicted in FIGS. 17*a* to 17*c*, the first part 331 and the second part 332 of the fairing element 330 are connected by a pivot connection PV. Advantageously, the stiffnesses of the two parts 331, 332 are chosen so that the passage from the deployed configuration into the folded configuration occurs, and preferably solely, as a result of relative pivoting of the two parts. In other words, the two parts have a rigidity or stiffness that is such that they do not deform under the effect of a torque higher than the threshold but are connected by a pivot connection about the first bearing edge.

In one particular alternative form, the fairing element comprises a stabilizing device DS configured to keep the two parts in the deployed relative position when the relative pivoting torque is less than or equal to the threshold and so as to allow the two parts to rotate relative to one another so that they pass into the relative position of folding around the first bearing edge when the torque exceeds the threshold. The stabilizing device for example comprises a deliberate weak link or a compression spring. What is meant by a deliberate weak link is a mechanical contrivance configured to release the pivot connection about the first bearing edge when the torque exceeds the threshold.

As an alternative, the pivot connection is free.

In another alternative form, the bearing edge is a flexible hinge zone connecting the two parts. The stiffness of the hinge zone is less than the stiffness of each of the two parts so that the fairing element passes from the deployed configuration into the folded configuration by the folding of the flexible hinge zone. Advantageously, the folding is achieved by elastic deformation of the flexible hinge zone. Advantageously, the hinge zone is configured to pass from the unfolded configuration into the folded configuration when the torque exceeds the predetermined threshold. The flexible hinge zone for example forms a pivot connection.

The hinge zone may be made from one and the same homogenous material as the two parts but thinned in relation to the two parts so as to exhibit lower stiffness. As an alternative, the hinge zone is made from a material that has a rigidity lower than that of material from which each of the two parts is formed and is fixed to each of the two parts. The two parts may be made from one and the same material or from different materials.

In the alternative form depicted in FIGS. 16*a* to 16*c*, the flexible part 232 extends the hydrodynamic shape of the rigid part 231. Thus, prior to folding, in the configuration of FIG. 16*a*, the fairing element 230 has the same shape as all the other fairing elements 13. Conversely, in the alternative form depicted in FIGS. 17*a* to 17*c*, the flexible part 332 of the fairing element 330 has a thinned shape the cross section of which is substantially constant from the flexible zone situated at the level of the mitered first bearing edge Bzb as far as the tip of the fairing element. This thinned shape in the region of the flexible zone makes it easier to achieve pivoting about the flexible zone. It is of course possible to create a flexible part 232 (FIGS. 16*a* to 16*c*) having a cross section that is constant, or alternatively to create a flexible part 332 (FIGS. 17*a* to 17*c*) having a cross section that decreases from the flexible zone as far as the tip of the fairing element so as to improve the hydrodynamics of the fairing element 330.

Advantageously, at least one mitered fairing element or each mitered fairing element is dimensioned so as to be better able to withstand a pressure load applied, in a direction perpendicular to the leading edge and parallel to an axis connecting the leading edge to the trailing edge, than the other fairing elements of the portion considered (which are not mitered) or alternatively, and more generally, than the non-mitered other fairing elements. This feature makes it possible to limit the risks of deformation and breakage of the fairing elements as they enter the guide device, turn over, and pass through this guide device. To this end, this fairing element is, for example, made from a harder material than the other fairing elements and/or comprises ribs providing this additional reinforcement. Advantageously, the fairing comprises at least one reinforced mitered end fairing element collaborating with the immobilizing device. That makes it possible to reduce the cost and possibly the weight of the fairing because only one the mitered fairing element or elements differs or differ from the others, all the others being identical.

The invention also relates to an assembly comprising a ship, the towing assembly being carried on board the ship. The ship is intended to move at a nominal speed in a nominal sea state. The towing assembly is installed on the ship in such a way that the tow point is situated at a nominal height.

The invention claimed is:

1. A fairing element to fair an elongate object comprising:

a canal that accepts the elongate object and being profiled to reduce a hydrodynamic drag of the elongate object when the elongate object is at least partially immersed, said fairing element comprising a leading edge and a trailing edge, said fairing element being pivot-mounted on the elongate object around a longitudinal axis of the canal, said fairing element comprising a bearing edge comprising:

a first bearing edge which is mitered with respect to the leading edge, the first bearing edge being arranged such that a distance between the leading edge and the bearing edge, perpendicular to the leading edge, decreases continuously, along an axis parallel to the leading edge, from a first end of the first bearing edge to a second end of the bearing edge, said fairing element a mitered fairing element, the mitered fairing element comprising:

a first part and a second part which are joined together along a first bearing edge so that the fairing element can pass from a deployed configuration in which the trailing edge is parallel to the leading edge to a folded configuration in which the fairing element is folded along the first bearing edge.

2. The fairing element as claimed in claim 1, wherein the mitered fairing element is configured to pass from the deployed configuration into the folded configuration when a torque inducing relative pivoting between the first part and the second part, applied about an axis comprised in the first bearing edge and parallel to a longitudinal axis of the first bearing edge, exceeds a predetermined threshold.

3. The fairing element as claimed in claim 2, wherein the predetermined threshold is higher than a nominal torque exerted by a hydrodynamic stream of water on the mitered fairing element when the mitered fairing element is immersed.

4. The fairing element as claimed in claim 3, wherein a cross section of the mitered fairing element is constant along the leading edge.

5. The fairing element as claimed in claim 4, wherein the first and the second part are arranged back to back along the first bearing edge.

6. The fairing element as claimed in claim 1, wherein a cross section of the mitered fairing element can vary along the leading edge.

7. The fairing element as claimed in claim 1, wherein said mitered fairing element is configured to move reversibly from the deployed configuration into the folded configuration.

8. The fairing element as claimed in claim 1, wherein the first part and the second part are arranged back to back along the first bearing edge; and wherein the first part has a stiffness greater than that of the second part so that the mitered fairing element passes from the deployed configuration into the folded configuration by folding of the second part.

9. The fairing element as claimed in claim 8, wherein the second part is made of a homogenous material.

10. The fairing element as claimed in claim 1, wherein the first part and the second part are connected by a pivot connection.

11. The fairing element as claimed in claim 10, further comprising a stabilizing device configured to keep the first part and the second part in a deployed relative position when a relative pivoting torque is less than or equal to a threshold and so as to allow the first part and the second part to rotate relative to one another so that they pass into a relative position of folding around the first bearing edge when the torque exceeds the threshold.

12. The fairing element as claimed in claim 1, wherein the first bearing edge is a flexible hinge zone connecting the first part and the second part and having a stiffness lower than the stiffness of each of the first part and the second part so that the fairing element passes from the deployed configuration to the folded configuration essentially by bending of the flexible hinge zone.

13. The fairing element as claimed in claim 1, wherein the bearing edge is arranged such that the distance between the bearing edge and the leading edge decreases continuously, along an axis parallel to the leading edge, from the first end of the first bearing edge to a first lateral face of the fairing element closer to the second end to the first bearing edge than to the first end of the bearing edge.

14. A fairing comprising a plurality of fairing elements which fair an elongate element comprising a canal that accepts the elongate object and being profiled to reduce a hydrodynamic drag of the elongate object when the elongate object is at least partially immersed, and which are pivot-mounted on the elongate element around the longitudinal axis of the canal, in which at least one of the fairing elements is a mitered fairing element as claimed in claim 1.

15. The fairing as claimed in claim 14, comprising at least one fairing portion comprising a plurality of fairing elements joined together along an axis of the canal and articulated to one another, said at least one fairing portion comprising at least one end fairing element, adjacent to one single other fairing element belonging to said at least one fairing portion, being a mitered fairing element having a bearing edge comprising a first bearing edge which is mitered with respect to the leading edge, the first bearing edge being arranged such that the distance between the leading edge and the first bearing edge, perpendicular to the leading edge, decreases continuously, along an axis parallel to the leading edge, from a first end of the first bearing edge to a second end of the first bearing edge, further away from the other fairing element than the first end, along the axis parallel to the leading edge.

16. The fairing as claimed in claim 15, wherein each mitered fairing element is an end fairing element.

17. The fairing as claimed in claim 14, wherein the mitered fairing element is sized to be more resistant to a pressure loading, applied in a direction perpendicular to the leading edge and connecting the leading edge to the trailing edge, than other fairing elements.

18. A faired elongate element for being at least partially immersed, comprising an elongate element faired by means of the fairing as claimed in claim 14, the elongate element being received in the canal, said fairing elements being pivot-mounted on the elongate element about the longitudinal axis of the canal and being translationally immobilized with respect to the elongate element along the axis of the elongate element.

19. A towing assembly comprising a faired elongate element as claimed in claim 18 and a towing and handling device to tow the faired elongate element while the faired elongate element is partially immersed, the towing and handling device comprising a winch allowing the faired elongate element to be wound in and paid out through a guide device that allows the faired elongate element to be guided, the guide device comprising a first groove, a bottom of which is formed by a bottom of a groove of a pulley, the first groove being delimited by a first surface having a profile that is concave in a radial plane of the pulley, a width of the first groove and a curvature of the profile of a first curved surface in the radial plane being determined as a function of a radius of the pulley, of a maximum length, measured parallel to a chord separating the trailing edge of the fairing elements of the fairing from the axis of the faired elongate element, of a maximum chord length of the fairing elements and of a maximum thickness of the fairing elements so as to allow a fairing element to be flipped by a rotating of the fairing element about the axis of the faired elongate element under an effect of traction of the faired elongate element with respect to the guide device along a longitudinal axis thereof, from a turned-over position in which the fairing element is oriented with an associated trailing edge toward the bottom of the first groove into an acceptable position oriented with the leading edge toward the bottom of the first groove.

20. The towing assembly as claimed in claim 19, in which the mitered fairing element is configured to fold along the first bearing edge while flipping from the turned-over position into the acceptable position.

* * * * *